US011545753B2

(12) United States Patent
O'Connor et al.

(10) Patent No.: US 11,545,753 B2
(45) Date of Patent: Jan. 3, 2023

(54) ELECTROMAGNETIC DIELECTRIC STRUCTURE ADHERED TO A SUBSTRATE AND METHODS OF MAKING THE SAME

(71) Applicant: ROGERS CORPORATION, Chandler, AZ (US)

(72) Inventors: Stephen O'Connor, West Roxbury, MA (US); Gianni Taraschi, Arlington, MA (US); Christopher Brown, Natick, MA (US); Kristi Pance, Auburndale, MA (US); Karl E. Sprentall, Medford, MA (US); Bruce Fitts, Phoenix, AZ (US); Dirk Baars, Chandler, AZ (US); William Blasius, Charlton, MA (US); Murali Sethumadhavan, Acton, MA (US); Roshin Rose George, Burlington, MA (US); Michael S. White, Pomfret Center, CT (US); Michael Lunt, Scotland, CT (US); Sam Henson, Scottsdale, AZ (US); John Dobrick, Rockwall, TX (US)

(73) Assignee: ROGERS CORPORATION, Chandler, AZ (US)

( * ) Notice: Subject to any disclaimer, the term of this patent is extended or adjusted under 35 U.S.C. 154(b) by 0 days.

(21) Appl. No.: 17/543,195

(22) Filed: Dec. 6, 2021

(65) Prior Publication Data

US 2022/0158351 A1 May 19, 2022

Related U.S. Application Data

(63) Continuation of application No. 16/396,943, filed on Apr. 29, 2019, now Pat. No. 11,239,563.

(Continued)

(51) Int. Cl.
*H01Q 9/04* (2006.01)
*H01Q 1/38* (2006.01)

(52) U.S. Cl.
CPC ..... *H01Q 9/0485* (2013.01); *H01Q 1/38* (2013.01)

(58) Field of Classification Search
CPC ..... H01Q 9/0485; H01Q 1/38; H01Q 15/08; H01Q 15/14; H01Q 21/0087
See application file for complete search history.

(56) References Cited

U.S. PATENT DOCUMENTS 6,075,485 A * 6/2000 Lilly ..... H01Q 9/0407 343/895
6,198,450 B1 3/2001 Adachi et al.
(Continued)

FOREIGN PATENT DOCUMENTS

CN 105924151 A 9/2016
JP 2001024420 A 1/2001
(Continued)

OTHER PUBLICATIONS

A. Anonymous: "Copper Foils For High Frequency Materials"; Jul. 24, 2019; 1-8 pages.

(Continued)

*Primary Examiner* — Haissa Philogene
(74) *Attorney, Agent, or Firm* — Cantor Colburn LLP

(57) ABSTRACT

An electromagnetic, EM, device, includes: a substrate having a dielectric layer and a first conductive layer at a first side of the substrate, the substrate having a via that extends at least partially through the substrate from the first side toward an opposing second side of the substrate; at least one dielectric structure having at least one non-gaseous dielectric material that forms a first dielectric portion that extends outward from the first side of the substrate, the first dielectric (Continued)

portion having a first average dielectric constant, the at least one dielectric structure further having a second dielectric portion that is contiguous with the first dielectric portion; wherein the second dielectric portion extends into the via of the substrate, the via having a mechanical interlock surface; and wherein the at least one dielectric structure includes a mechanical interlock between the second dielectric portion and the mechanical interlock surface of the via of the substrate.

29 Claims, 20 Drawing Sheets

Related U.S. Application Data

(60) Provisional application No. 62/671,022, filed on May 14, 2018, provisional application No. 62/665,072, filed on May 1, 2018.

(56) References Cited

U.S. PATENT DOCUMENTS

| | | | | |
|---|---|---|---|---|
| 7,405,698 | B2 * | 7/2008 | de Rochemont | H01Q 15/006 343/909 |
| 7,876,283 | B2 * | 1/2011 | Bouche | H01Q 9/44 343/700 MS |
| 8,497,804 | B2 * | 7/2013 | Haubrich | H01Q 1/27 607/60 |
| 9,196,523 | B2 | 11/2015 | Lin | |
| 9,214,388 | B2 | 12/2015 | Farooq et al. | |
| 9,455,488 | B2 * | 9/2016 | Chirila | H01Q 5/364 |
| 9,917,044 | B2 * | 3/2018 | Zhou | H01L 21/76879 |
| 10,062,656 | B2 | 8/2018 | Chang et al. | |
| 11,108,159 | B2 | 8/2021 | Pance et al. | |
| 11,239,563 | B2 * | 2/2022 | O'Connor | H01Q 1/38 |
| 2003/0151474 | A1 | 8/2003 | Wada et al. | |
| 2005/0264449 | A1 * | 12/2005 | Strickland | H01Q 1/288 343/700 MS |
| 2006/0293168 | A1 | 12/2006 | Mori et al. | |
| 2008/0129617 | A1 * | 6/2008 | Li | H01Q 21/24 343/700 MS |
| 2017/0125908 | A1 | 5/2017 | Pance et al. | |
| 2019/0221926 | A1 * | 7/2019 | Pance | H01Q 19/06 |
| 2019/0221940 | A1 * | 7/2019 | Pance | H01Q 19/18 |
| 2020/0083602 | A1 * | 3/2020 | Sethumadhavan | H01Q 13/02 |

FOREIGN PATENT DOCUMENTS

| | | | |
|---|---|---|---|
| JP | 2004153607 | A | 5/2004 |
| JP | 2005064548 | A | 3/2005 |

OTHER PUBLICATIONS

John A. Marshall; "Measuring Copper Surface Roughness for high Speed Applications"; Proceedings of IPC Apex 2015; Dec. 31, 2015; 7 pages.

Notification of Transmittal of the International Search Report for Application No. PCT/US2019/029857; dated Jul. 25, 2019; 6 pages.

Written Opinion of the International Searching Authority for Application No. PCT/US2019/029857; dated Jul. 25, 2019; 12 pages.

* cited by examiner

ELECTROMAGNETIC DIELECTRIC STRUCTURE ADHERED TO A SUBSTRATE AND METHODS OF MAKING THE SAME

CROSS REFERENCE TO RELATED APPLICATIONS

This application claims the benefit of U.S. Application Ser. No. 16/396,943, filed Apr. 20, 2019, which claims the benefit of U.S. Provisional Application Ser. No. 62/671,022, filed May 14, 2018, and claims the benefit of U.S. Provisional Application Ser. No. 62/665,072, filed May 1, 2018, which are all incorporated herein by reference in their entireties.

BACKGROUND

The present disclosure relates generally to a dielectric structure attachment assembly, particularly to an electromagnetic device, and more particularly to a dielectric resonator antenna (DRA) system, a dielectric electronic filter, or a dielectric loaded antenna.

While existing dielectric structures and arrays thereof may be suitable for their intended purpose, the art of dielectric structures would be advanced with an improved attachment arrangement for improving the adhesion of the dielectric structures to a substrate.

BRIEF SUMMARY

In an embodiment, an electromagnetic, EM, device, comprises: a substrate comprising a dielectric layer and a first conductive layer at a first side of the substrate, the substrate comprising a via that extends at least partially through the substrate from the first side toward an opposing second side of the substrate; at least one dielectric structure comprising at least one non-gaseous dielectric material that forms a first dielectric portion that extends outward from the first side of the substrate, the first dielectric portion having a first average dielectric constant, the at least one dielectric structure further comprising a second dielectric portion that is contiguous with the first dielectric portion; wherein the second dielectric portion extends into the via of the substrate, the via comprising a mechanical interlock surface; and wherein the at least one dielectric structure comprises a mechanical interlock between the second dielectric portion and the mechanical interlock surface of the via of the substrate.

In an embodiment, a method of making an electromagnetic, EM, device that comprises: a substrate comprising a dielectric layer and a first conductive layer at a first side of the substrate, the substrate comprising a via that extends at least partially through the substrate from the first side toward an opposing second side of the substrate; at least one dielectric structure comprising at least one non-gaseous dielectric material that forms a first dielectric portion that extends outward from the first side of the substrate, the first dielectric portion having a first average dielectric constant, the at least one dielectric structure further comprising a second dielectric portion that is contiguous with the first dielectric portion; wherein the second dielectric portion extends into the via of the substrate, the via comprising a mechanical interlock surface; and wherein the at least one dielectric structure comprises a mechanical interlock between the second dielectric portion and the mechanical interlock surface of the via of the substrate, the method comprising: injection molding a dielectric composition onto the substrate to form the device, the dielectric composition forming at least part of the at least one dielectric structure.

In an embodiment, an electromagnetic device, comprises a substrate comprising a dielectric layer and a first conductive layer; at least one dielectric structure comprising at least one non-gaseous dielectric material that forms a first dielectric portion that extends outward from the first side of the substrate, the first dielectric portion having an average dielectric constant and an optional second dielectric portion that extends into an optional via. The at least one dielectric structure is bonded to the substrate by at least one of: a mechanical interlock between the second dielectric portion and the substrate due to the at least one interlocking slot comprising a retrograde surface; an intermediate layer located in between the dielectric structure and the substrate having a roughened surface; or an adhesive material located in between the dielectric structure and the substrate.

A method of making the device can comprise injection molding a dielectric composition onto the substrate to form the device.

The above described and other features are exemplified by the following figures, detailed description, and claims.

BRIEF DESCRIPTION OF THE DRAWINGS

Referring to the exemplary non-limiting drawings wherein like elements are numbered alike in the accompanying Figures.

DETAILED DESCRIPTION

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claims.

An embodiment, as shown and described by the various figures and accompanying text, provides a dielectric structure attachment assembly that forms an electromagnetic device, which in an embodiment may be suitable for use as a dielectric resonator antenna, a dielectric electronic filter, or a dielectric loaded antenna, for example.

Figure 1:
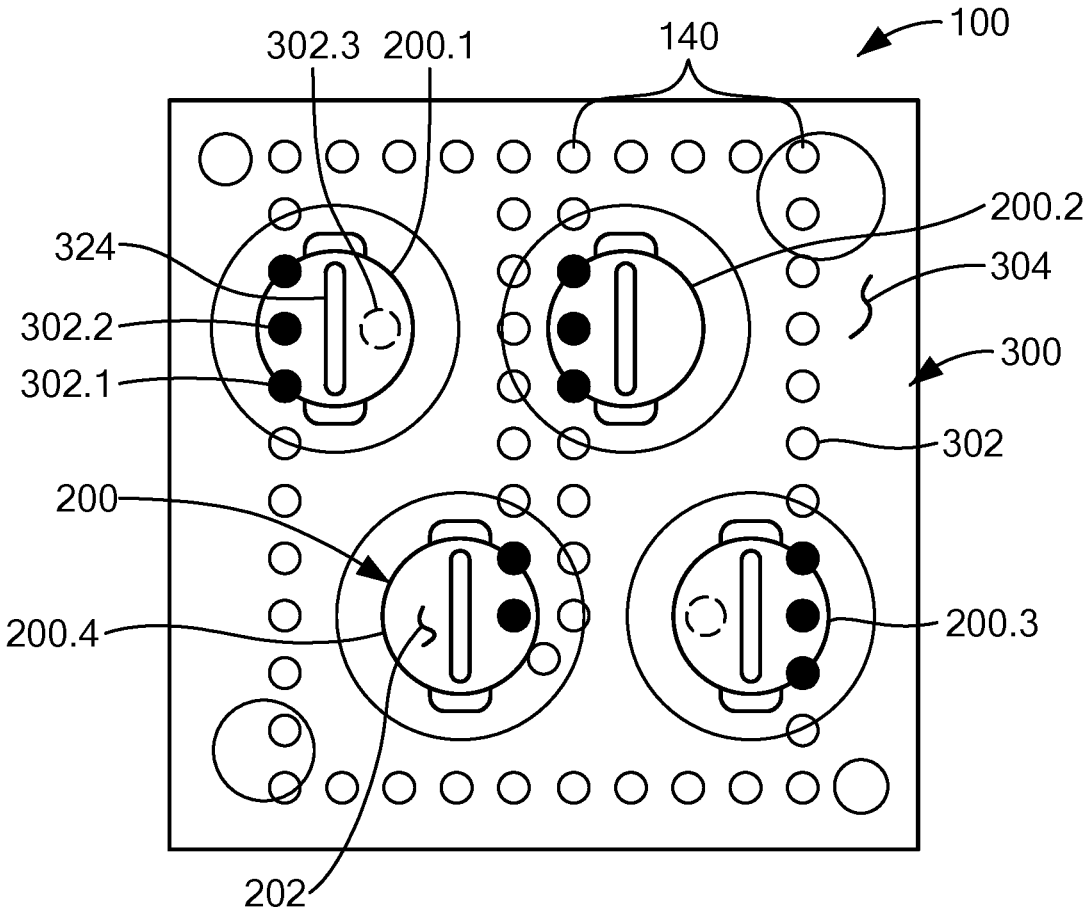
FIG. 1 depicts an example electromagnetic device, in accordance with an embodiment.

FIG. 1 depicts a transparent plan view of an electromagnetic (EM) device 100 having one or more features of an embodiment disclosed and described herein below. In general, the EM device 100 has at least one dielectric structure 200 (individually referred to by reference numerals 200.1, 200.2, 200.3, 200.4) that is bonded to a substrate 300 in one or more different ways (described in detail below). In an embodiment, the substrate 300 has at least one via 302 that extends at least partially through the substrate 300 from a first side 304 (top side depicted in FIG. 1) toward an opposing second side 306 (bottom side not depicted in FIG. 1, best seen with reference to at least FIG. 2B) of the substrate 300. In an embodiment, the vias 302 may be vertical, aligned with a z-axis depicted in FIGS. 2A-2C for example, or may be slightly non-vertical due to fabrication variances. In an embodiment, the dielectric structure 200 has at least one non-gaseous dielectric material 202 that forms a first dielectric portion 204 that extends outward from the first side 304 of the substrate 300, the first dielectric portion 204 having an average dielectric constant. While the substrate 300 is depicted herein being a laminate structure of dielectric material and conductive material (discussed further herein below), it will be appreciated that this is for illustration purposes only and that other forms of substrates 300 are contemplated, such as but not limited to: a printed circuit board (PCB) laminate; a flex PCB; a flexible sheet material; a polymer-based sheet material; an electronics wafer material; a semiconductor wafer; an insulating wafer; or, a metal sheet. In an embodiment and as disclosed in further detail herein below, the dielectric structure 200 is bonded to the substrate 300 at least partially by a bonding at an interface between the dielectric structure 200 and the at least one via 302, which will now be described with reference to at least FIGS. 1-9B.

In an embodiment, the EM device 100 may be a dielectric resonator antenna (DRA) where the dielectric structure 200 is at least part of the DRA.

Figure 2A:
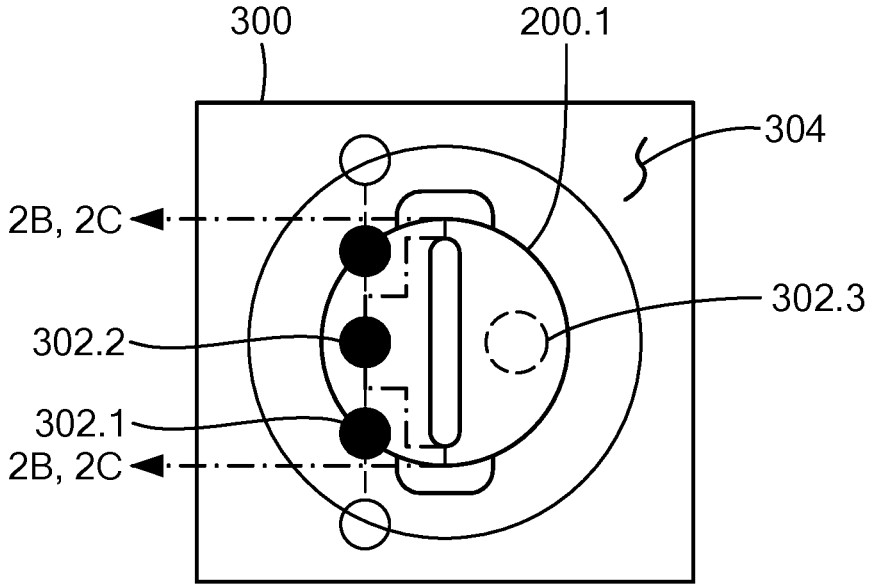
FIGS. 2A, 2B, and 2C depict example alternative embodiments of a dielectric structure bonded to a substrate having an electrically conductive through via, in accordance with an embodiment.
Figure 2B:
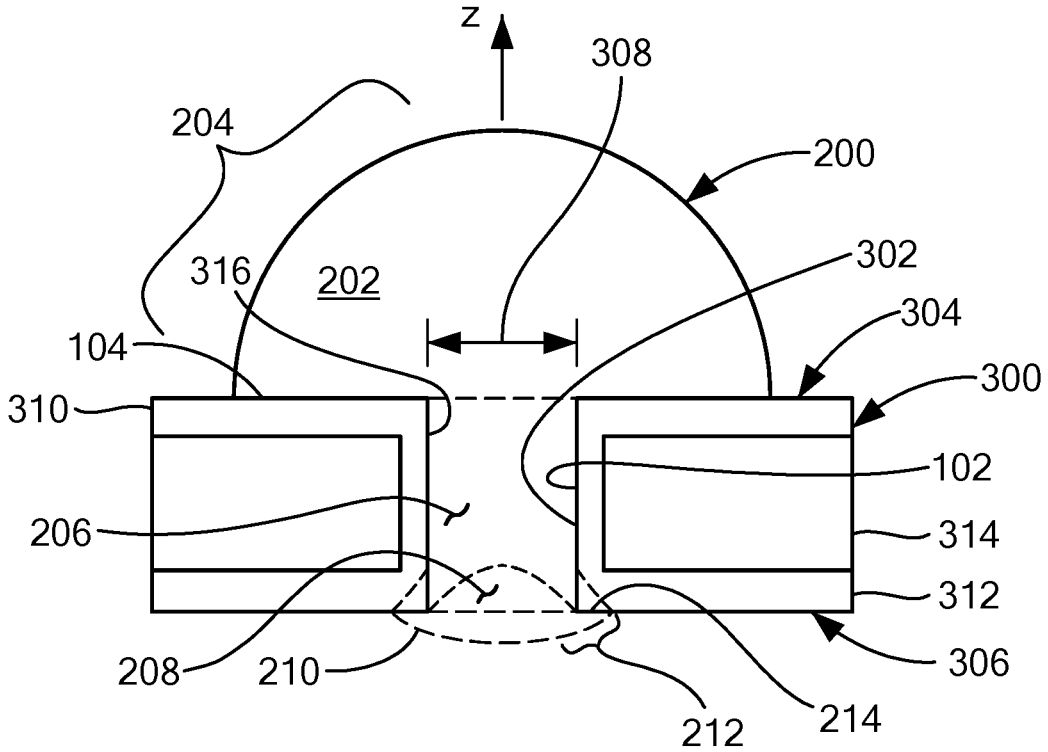
Figure 2C:
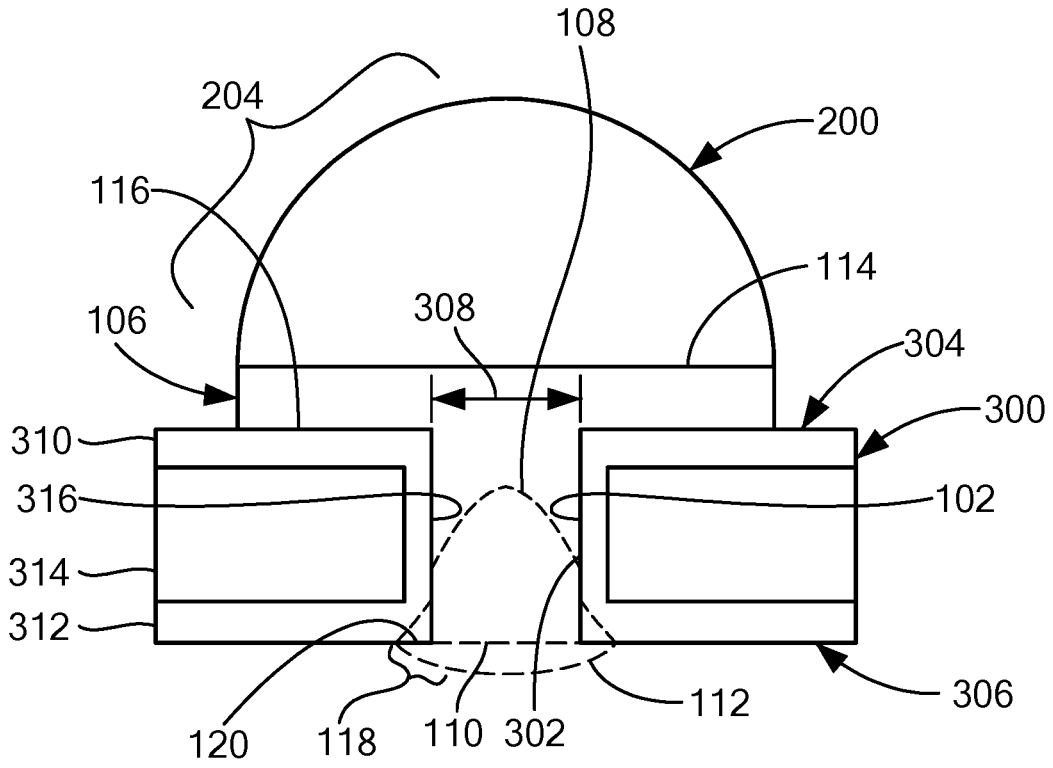

Reference is now made to FIGS. 2A, 2B, and 2C, where FIG. 2A depicts dielectric structure 200.1 on substrate 300, FIG. 2B depicts a cross section side view of a first embodiment of the dielectric structure 200.1 taken through section cut line 2B-2B, and FIG. 2C depicts a cross section side view of a second embodiment of the dielectric structure 200.1 taken through section cut line 2C-2C. As depicted in at least FIGS. 1 and 2A, the dielectric structure 200, 200.1 is disposed on the first side 304 of the substrate 300 so as to only partially cover one of the vias 302.1, or is disposed so as to completely cover one of the vias 302.2. Also, one or more optional secondary vias 302.3 (only two secondary vias 302.3 depicted and only one enumerated in FIG. 1, but an embodiment may include other secondary vias 302.3 associated with other dielectric structures 200) may be disposed on an opposing side of the dielectric structure 200, 200.1, across from a signal feed slot 324, for example. The secondary vias 302.3 may be the same size or a different size than vias 302.1, 302.2. As depicted in both FIGS. 2B and 2C, an example via 302 extends completely through the substrate 300.

With reference to FIG. 2B, the non-gaseous dielectric material 202 forms a second dielectric portion 206 that extends only partially into the via 302 forming an underfilled via, or forms a second dielectric portion 206, 208 that extends completely into the via 302 forming a completely filled via, or forms a second dielectric portion 206, 208, 210 that extends completely into the via 302 and beyond forming an overfilled via, where the second dielectric portion 206, 208, 210 is contiguous and seamless with the first dielectric portion 204. In an embodiment, the dielectric structure 200 is not only partially bonded to the substrate 300 by a bonding at an interface 102 between the dielectric structure 200 and the via 302, but is further bonded to the substrate 300 by a bonding at an interface 104 between the first dielectric portion 204 and the first side 304 of the substrate 300. In an embodiment of the overfilled via 302, a third dielectric portion 212 of the non-gaseous dielectric material 202 that extends outward beyond an inner diameter opening 308 of the via 302 on the second side 306 of the substrate 300 forms a shouldered interlock 214 between the third dielectric portion 212 and the second side 306 of the substrate 300, where the third dielectric portion 212 is contiguous and seamless with the second dielectric portion 206, 208, 210, and where the dielectric structure 200 is further bonded to the substrate 300 by a bonding at an interface 214 between the third dielectric portion 212 and the second side 306 of the substrate 300. In an embodiment, the substrate 300 includes a first conductive layer 310 on the first side 304, a second conductive layer 312 on the second side 306, and a dielectric layer 314 between the first and second conductive layers 310, 312, and the via 302 has interior walls 316 that are electrically connected between the first and second conductive layers 310, 312. In an embodiment, the dielectric structure 200 as depicted in FIG. 2B, for example, may be fabricated by a molding process, such as injection molding, compression molding, or transfer molding, for example. Alternatively, an embodiment of the dielectric structure 200 as depicted in FIG. 2B, for example, may be fabricated by way of a thermal lamination process.

With reference to FIG. 2C, the dielectric structure 200 has an adhesive material 106 disposed between the first dielectric portion 204 and the substrate 300, the via 302 extends completely through the substrate 300, and the adhesive material extends: (i) only partially into the via forming an underfilled via, represented by dashed line 108; or, (ii) extends completely into the via forming a completely filled via, represented by dashed line 110; or, (iii) extends completely into the via and beyond forming an overfilled via, represented by dashed line 112. In an embodiment, the adhesive material 106 has an average dielectric constant, and the dielectric constants of the adhesive material 106 and the first dielectric portion 204 are substantially matched. In an embodiment, the dielectric structure 200 is not only partially bonded to the substrate 300 by a bonding at an interface 102 between the dielectric structure 200 and the via 302, but is further bonded to the substrate 300 by a bonding at an interface 114 between the first dielectric portion 204 and the adhesive 106 and an interface 116 between the adhesive 106 and the first side 304 of the substrate 300. In an embodiment of the overfilled via 302, a portion 118 of the adhesive 106 extends outward beyond an inner diameter opening 308 of the via 302 on the second side 306 of the substrate 300 to form a shouldered interlock 120 between the portion 118 of the adhesive 106 and the second side 306 of the substrate 300. Similar to the substrate 300 depicted in FIG. 2B, the substrate 300 depicted in FIG. 2C also includes a first conductive layer 310 on the first side 304, a second conductive layer 312 on the second side 306, and a dielectric layer 314 between the first and second conductive layers 310, 312, and the via 302 has interior walls 316 that are electrically connected between the first and second conductive layers 310, 312. In an embodiment, the first dielectric portion 204 as depicted in FIG. 2C may be fabricated by a molding process and then adhered to the substrate 300 by the adhesive 106 and a pick-and-place assembly process.

Figure 3A:
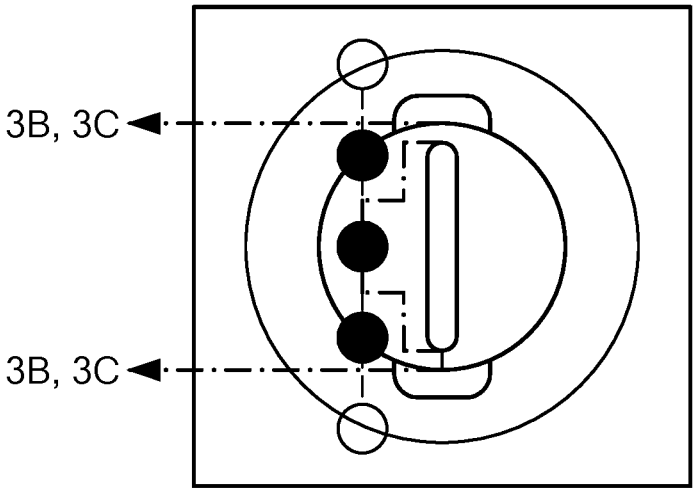
FIGS. 3A, 3B, and 3C depict example alternative embodiments of a dielectric structure bonded to a substrate having a non-electrically conductive through via, in accordance with an embodiment.
Figure 3B:
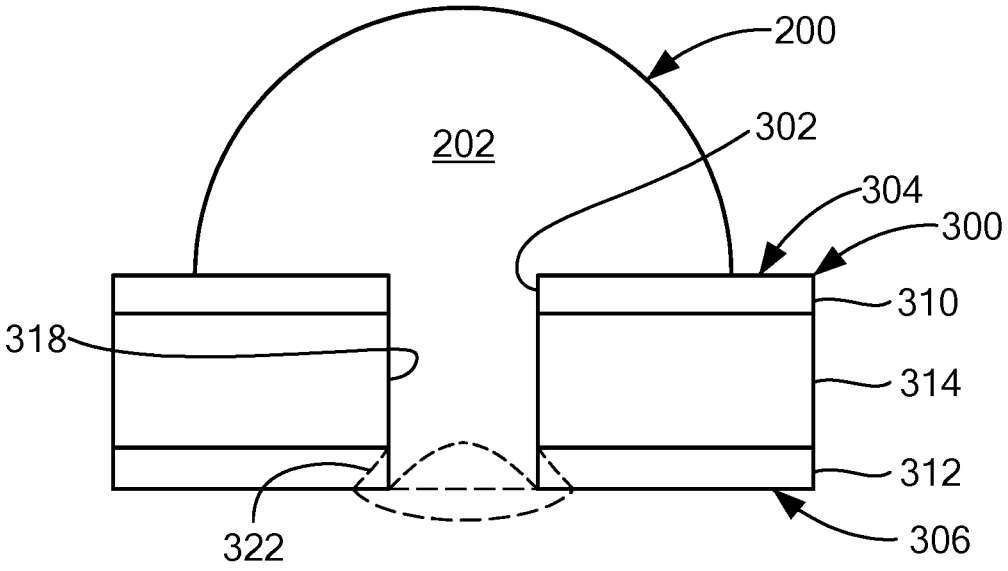
Figure 3C:
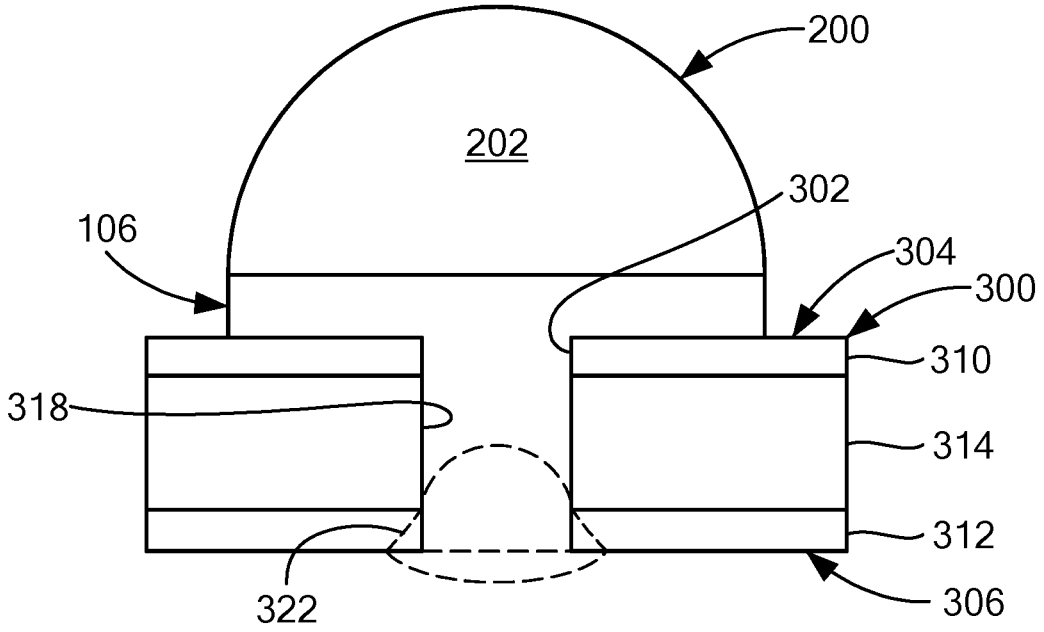

Reference is now made to FIGS. 3A, 3B, and 3C, where each respective figure is identical to the corresponding FIGS. 2A, 2B, and 2C, except for the following differences. In an embodiment, the substrate 300 has a first conductive layer 310 on the first side 304, a second conductive layer 312 on the second side 306, and a dielectric layer 314 between the first and second conductive layers 310, 312, but the via 302 has non-conductive interior walls 318 that electrically insulate the first and second conductive layers 310, 312. In view of the other similarities of the structures depicted in FIGS. 3A, 3B, and 3C as compared to those depicted in FIGS. 2A, 2B, and 2C, and discussed in detail above, a repeat description of like features is considered unnecessary as one skilled in the art would appreciate the like features by comparing the noted figures.

In an embodiment and as depicted in FIGS. 2B, 2C, 3B, and 3C, the second side 306 of the substrate 300 around the bottom perimeter of the via 302 may include a chamfer, counterbore, or notch 322 (depicted in FIGS. 2B, 2C, 3B, and 3C, but enumerated in only FIGS. 3B and 3C for clarity), which when filled with non-gaseous dielectric material 202 or adhesive material 106 will provide another form of structural attachment in addition to that of the shouldered interlocks 214 and 120 discussed herein above.

Figure 4A:
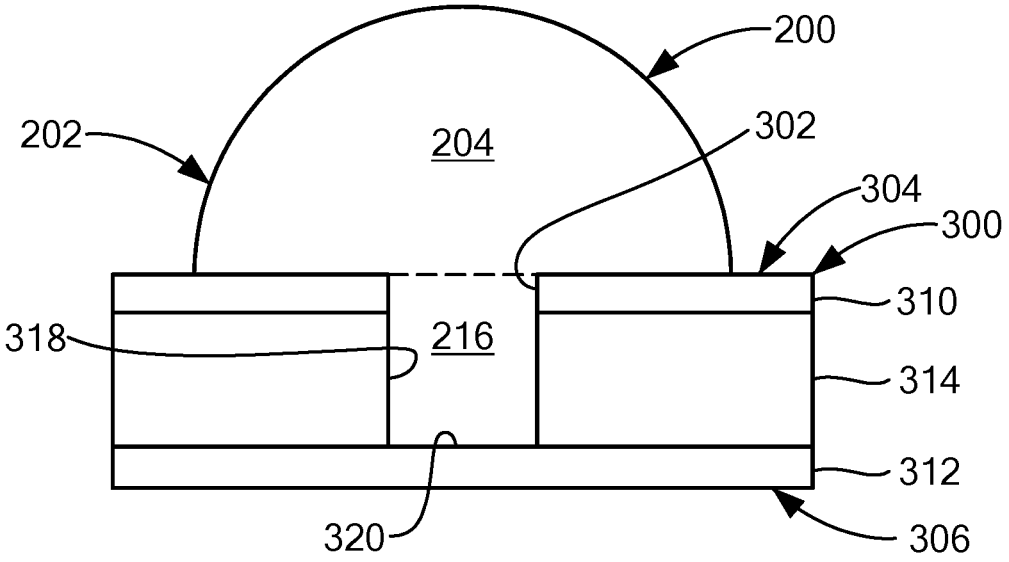
FIGS. 4A and 4B depict example alternative embodiments of a dielectric structure bonded to a substrate having a non-electrically conductive blind via, in accordance with an embodiment.
Figure 4B:
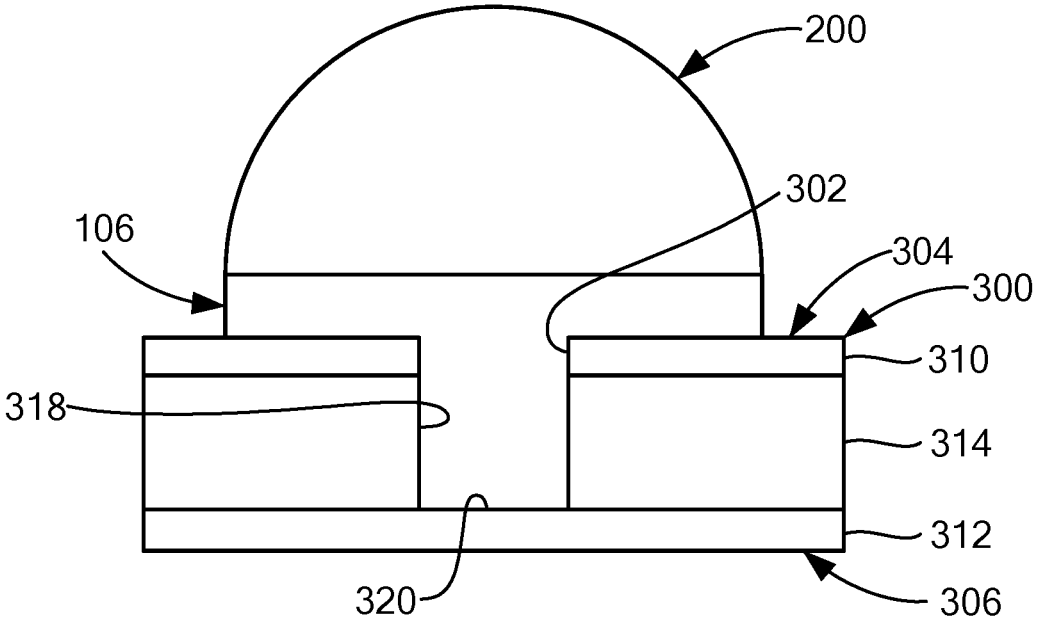

Reference is now made to FIGS. 4A and 4B, where each respective figure is identical to the corresponding FIGS. 3B and 3C, except for the following differences. In an embodiment, the via 302 is a blind via that extends completely through the first conductive layer 310 and the dielectric layer 314, and terminates at the second conductive layer 312 that forms the blind end 320 of the via 302. With specific reference now to the dielectric structure 200 depicted in FIG. 4A, the non-gaseous dielectric material 202 not only forms the first dielectric portion 204, but also forms a second dielectric portion 216 that extends into the blind via 302 forming a substantially filled blind via 302, where the second dielectric portion 216 is contiguous and seamless with the first dielectric portion 204. With specific reference now to the dielectric structure 200 depicted in FIG. 4B, it can be seen that the adhesive material 106 extends into the blind via 302 forming a substantially filled blind via 302. In view of the other similarities of the structures depicted in FIGS. 4A and 4B as compared to those depicted in FIGS. 3B and 3C, and discussed in detail above, a repeat description of like features is considered unnecessary as one skilled in the art would appreciate the like features by comparing the noted figures.

Figure 5A:
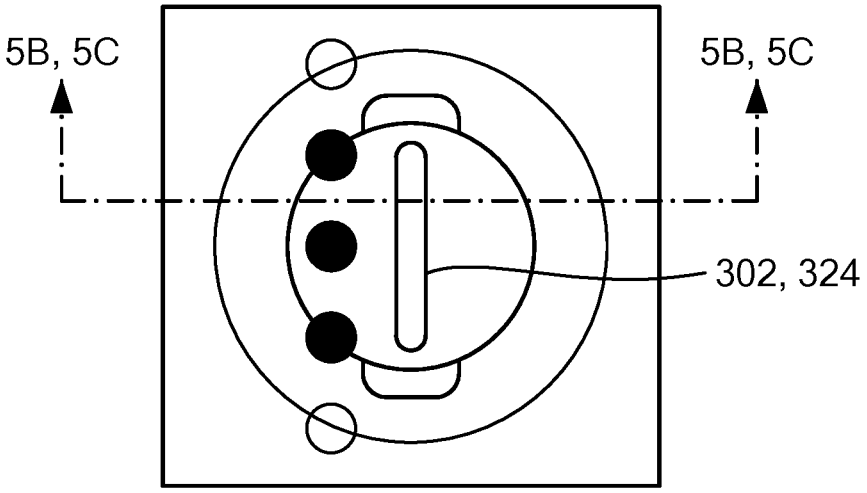
FIGS. 5A, 5B, and 5C depict example alternative embodiments of a dielectric structure bonded to a substrate having an opening in a metal layer, in accordance with an embodiment.
Figure 5B:
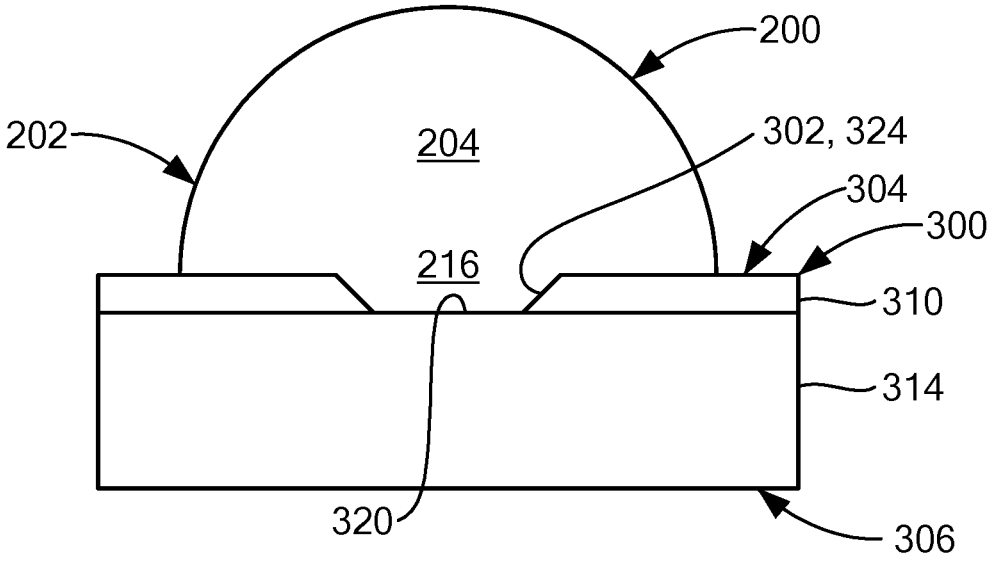
Figure 5C:
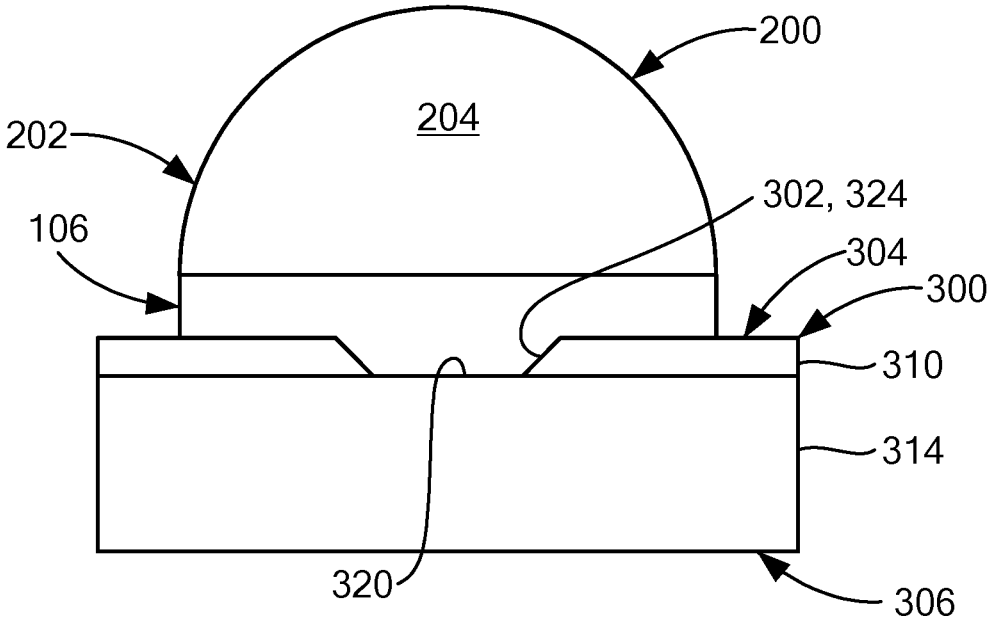
Figure 6A:
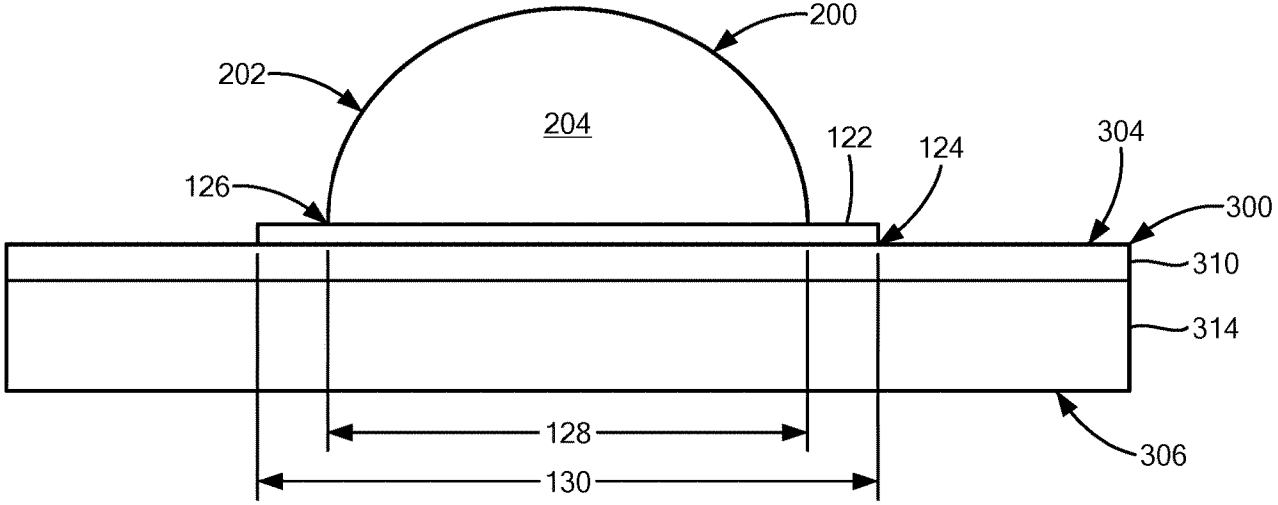
FIGS. 6A and 6B depict example alternative embodiments of a dielectric structure bonded to a substrate employing an expanded intermediate layer, in accordance with an embodiment.
Figure 6B:
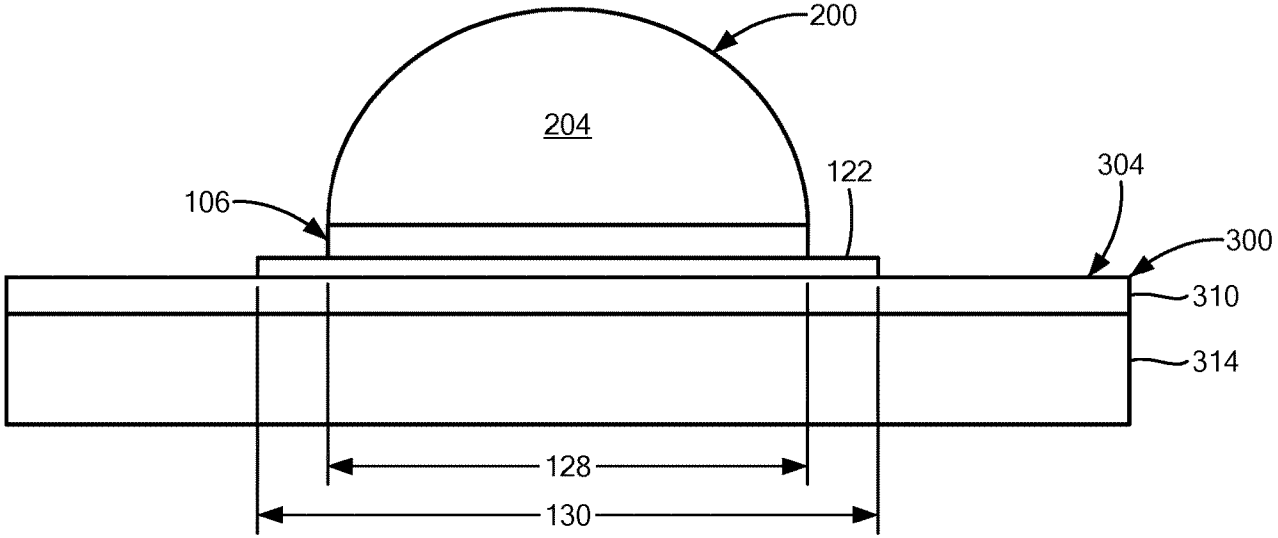

Reference is now made to FIGS. 5A, 5B, and 5C, where each respective figure is similar to the corresponding FIGS. 3A, 3B, and 3C, except for the following differences. In an embodiment and with specific reference to FIG. 5B, the substrate 300 has a conductive layer 310 on the first side 304, and a dielectric layer 314 adjacent the conductive layer 310. In the embodiments of FIGS. 5A, 5B, and 5C, an open region, such as a signal feed slot 324, for example, forms type of via 302 that is a blind via that extends completely through the conductive layer 310 and terminates at the dielectric layer 314 that forms the blind end 320 of the via 302. In an embodiment this specific via 302, 324 may be a straight or a curved slot, and alternatively may be similar in both in-plane dimensions, such as a square or a circle, for example. The non-gaseous dielectric material 202 not only forms the first dielectric portion 204, but also forms a second dielectric portion 216 that extends into the blind via 302 forming a substantially filled blind via 302, where the second dielectric portion 216 is contiguous and seamless with the first dielectric portion 204. In another embodiment and with specific reference to FIG. 5C, the dielectric structure 200 has an adhesive material 106 disposed between the first dielectric portion 204 and the substrate 300. The substrate 300 has a conductive layer 310 on the first side 304, and a dielectric layer 314 adjacent the conductive layer 310. The via 302 is a blind via that extends completely through the conductive layer 310 and terminates at the dielectric layer 314 that forms the blind end 320 of the via 302. The adhesive material 106 extends into the blind via 302 forming a substantially filled blind via 302, and the dielectric constants of the adhesive material 106 and the first dielectric portion 204 are substantially matched. In view of the other similarities of the structures depicted in FIGS. 5B and 5C as compared to those depicted in FIGS. 3B and 3C, and discussed in detail above, a repeat description of like features is considered unnecessary as one skilled in the art would appreciate the like features by comparing the noted figures.

Figure 7A:
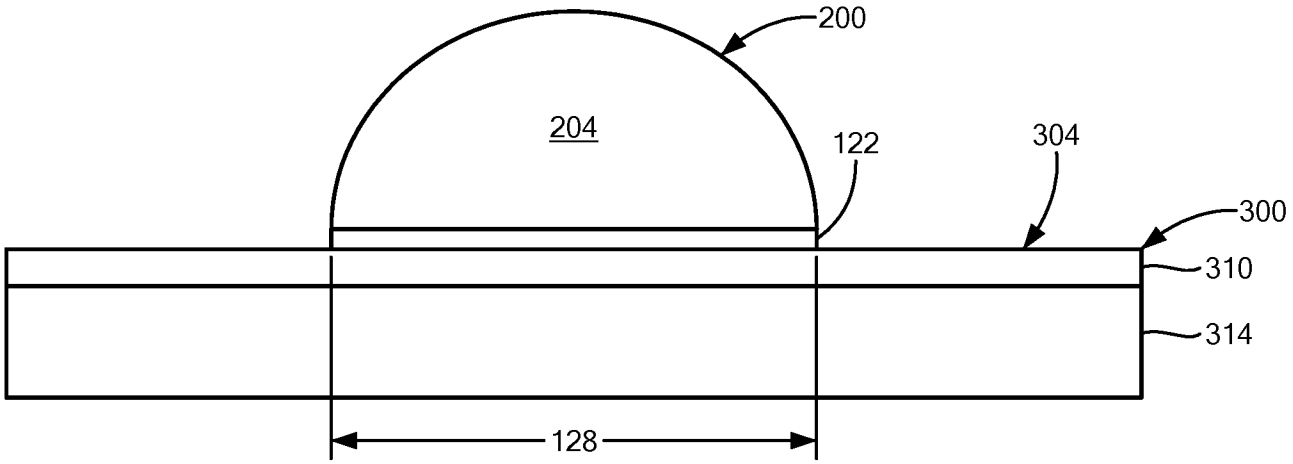
FIGS. 7A and 7B depict example alternative embodiments of a dielectric structure bonded to a substrate employing a non-expanded intermediate layer, in accordance with an embodiment.
Figure 7B:
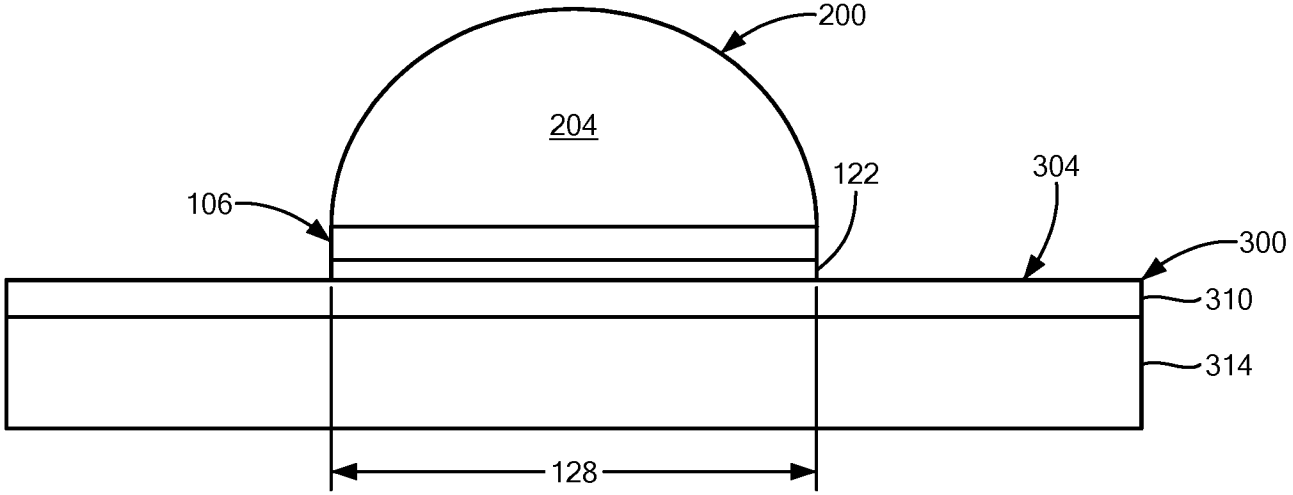

Reference is now made to FIGS. 6A, 6B, 7A, and 7B, where like elements depicted in these and other figures are numbered alike. In an embodiment and with specific reference to FIG. 6A, the EM device 100 (see FIG. 1 for example) includes a substrate 300 having a first side 304 and an opposing second side 306, a dielectric structure 200 having at least one non-gaseous dielectric material 202 that forms a dielectric portion 204 that extends outward from the first side 304 of the substrate 300, where the dielectric portion 204 has an average dielectric constant, an intermediate layer 122 disposed between the dielectric portion 204 and the first side 304 of the substrate 300, and wherein the dielectric structure 200 is bonded to the substrate 300 at least partially by a bonding at an interface 124 between the intermediate layer 122 and the substrate 300. Furthermore, the dielectric structure 200 is further bonded to the substrate 300 by a bonding at an interface 126 between the dielectric portion 204 and the intermediate layer 122. In another embodiment and with specific reference to FIG. 6B, the dielectric structure 200 has an adhesive material 106 disposed between the dielectric portion 204 and the intermediate layer 122, where the dielectric constants of the adhesive material 106 and the dielectric portion 204 are substantially matched. As depicted in both FIGS. 6A and 6B, the intermediate layer 122 covers an entire area between the dielectric portion 204 and the first side 304 of the substrate 300, and may not or may extend beyond an outer edge of the dielectric portion 204, as denoted by dimensions 128 and 130, respectively. Reference is now made specifically to FIGS. 7A and 7B, where the intermediate layer 122 covers an entire area between the dielectric portion 204 and the first side 304 of the substrate 300, and does not extend beyond an outer edge of the dielectric portion 204, as denoted by dimension 128. As depicted in FIGS. 6A, 6B, 7A, and 7B, the substrate 300 has a conductive layer 310 disposed on the first side 304, and a dielectric layer 314 adjacent the conductive layer 310, where the conductive layer 310 is disposed between the intermediate layer 122 and the dielectric layer 314. In an embodiment, the intermediate layer 122 has an average surface roughness that is greater than an average surface roughness of the conductive layer 310. In an embodiment, the intermediate layer 122 is composed of: an oxide material; a copper oxide; a black oxide; a nitride material; a layer of atomic deposition material; a layer of vapor deposition material; or, any combination of the foregoing materials. In an embodiment the final intermediate layer 122 may be formed by a masked deposition process during formation of the intermediate layer, or may be formed by removal of intermediate layer material with a masked removal process. With respect to the embodiments depicted in FIGS. 7A and 7B, an etch process may be employed to effect termination of the intermediate layer 122 substantially at the outer edge of the dielectric structure 200 as depicted by dimension 128. In an embodiment, the etch process may be an acetic acid etch process.

Figure 8A:
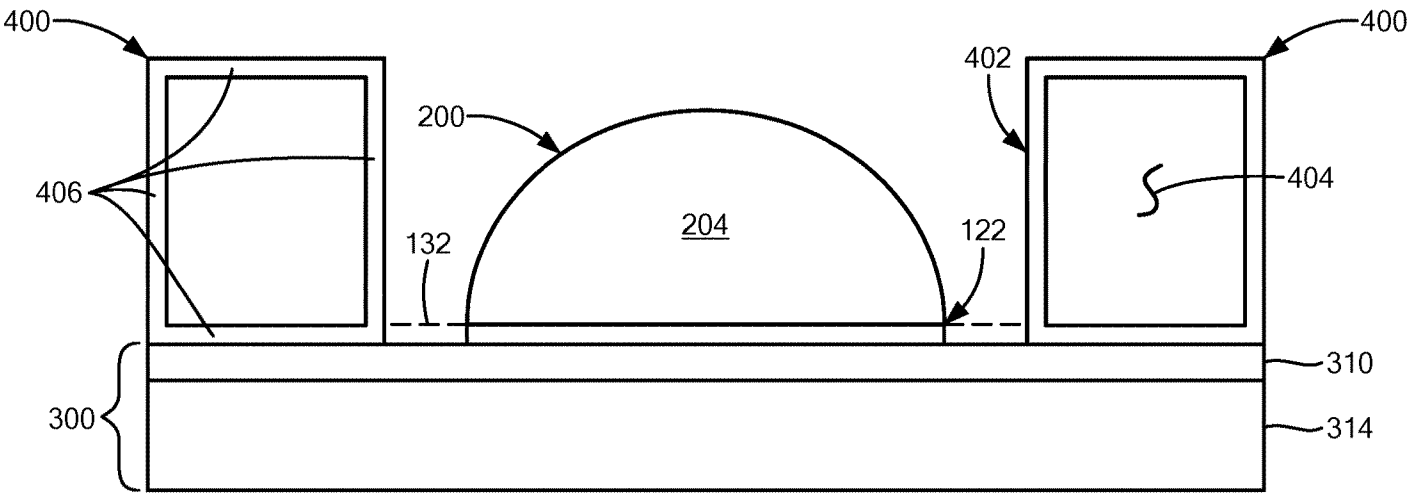
FIGS. 8A and 8B depict example alternative embodiments of a dielectric structure bonded to a substrate similar to those of FIGS. 6A, 6B, 7A, and 7B, and employing a metallized structure, in accordance with an embodiment.
Figure 8B:
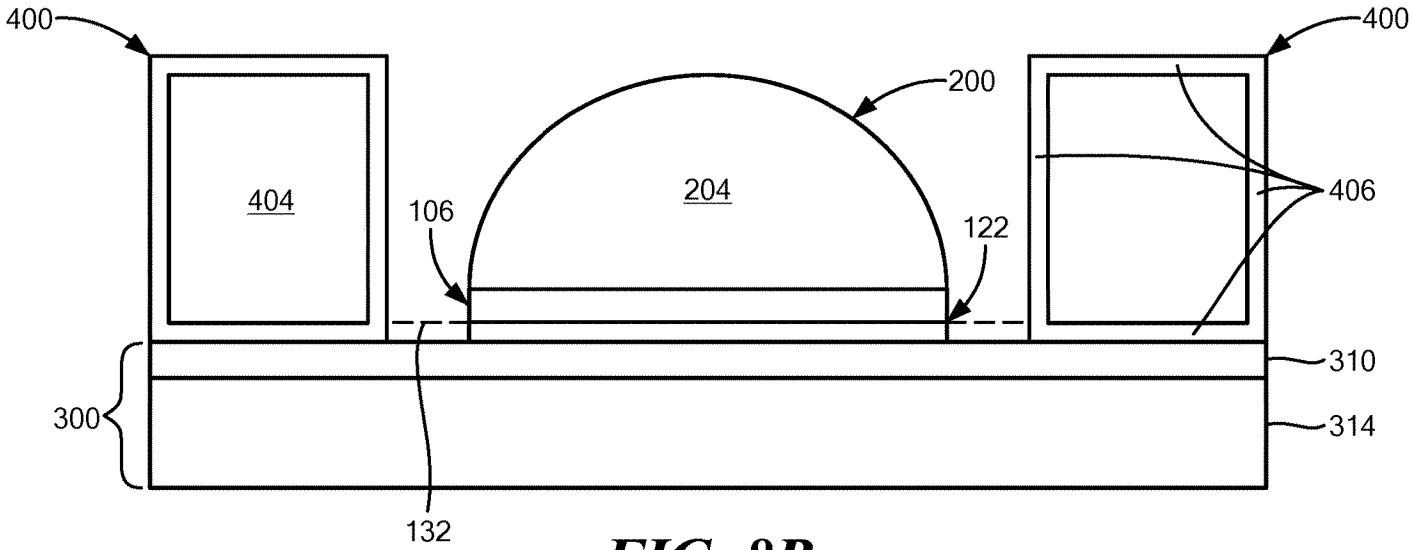

Reference is now made to FIGS. 8A and 8B, which depict embodiments similar to those of FIGS. 6A, 6B, 7A, and 7B where like elements are numbered alike, except with the following differences. In an embodiment, the EM device 100 (see FIG. 1 for example), includes a metallized structure 400 disposed on and electrically connected to the conductive layer or the first conductive layer 310, where the metallized structure 400 forms a plurality of metal fences, with each metal fence 402 of the plurality of metal fences surrounding or substantially surrounding a corresponding one of the dielectric structure 200. In an embodiment, the metallized structure 400 has a dielectric inner portion 404 and an electrically conductive outer portion 406. As depicted by dashed lines 132 in FIGS. 8A and 8B, the intermediate layer 122 between the dielectric structure 200 and the substrate 300 optionally may extend outward from the dielectric structure 200 to the metallized structure 400.

Figure 9A:
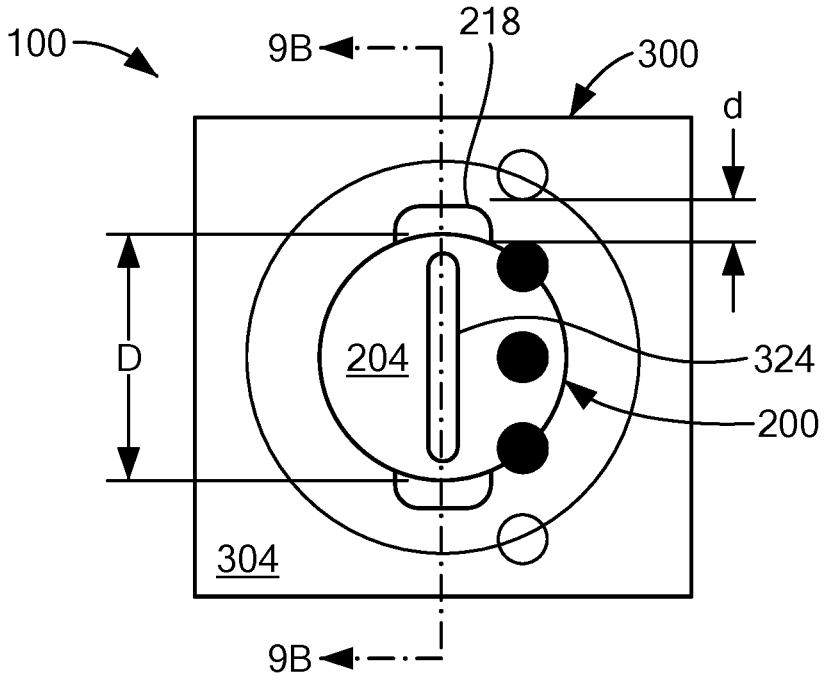
FIGS. 9A and 9B depict an example of a dielectric structure having side wing portions bonded to a substrate, in accordance with an embodiment.
Figure 9B:
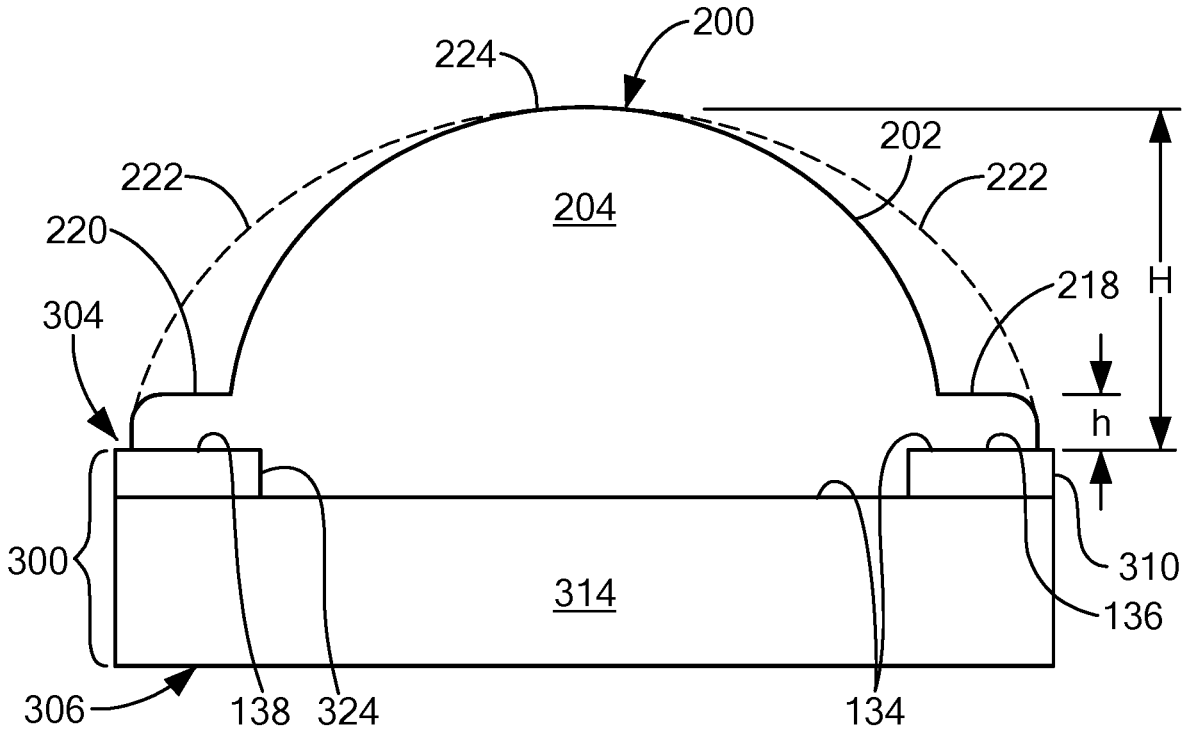

Reference is now made to FIGS. 9A and 9B, where FIG. 9A is a transparent plan view of an EM device 100 (see dielectric structure 200.3 of the EM device 100 in FIG. 1 for example), and FIG. 9B is an elevation section view through section cut line 9B-9B in FIG. 9A. In an embodiment, the EM device 100 includes a substrate 300 having a first side 304 and an opposing second side 306, at least one dielectric structure 200 having at least one non-gaseous dielectric material 202 that forms a first dielectric portion 204 that extends outward from the first side 304 of the substrate 300, where the dielectric structure 200 further includes non-gaseous dielectric material 202 that forms second dielectric portion (side wing portion) 218 that extends sideways from the first dielectric portion 204, and where the dielectric structure 200 is bonded to the substrate 300 at least partially by a bonding at an interface 134 between the first dielectric portion 204 and the substrate 300, and an interface 136 between the second dielectric portion 218 and the substrate 300. In an embodiment, the non-gaseous dielectric material 202 further forms a third dielectric portion (side wing portion) 220 similar to the second dielectric portion 218 that extends sideways from the first dielectric portion 204 in opposition to the second dielectric portion 218, and the dielectric structure 200 is further bonded to the substrate 300 at an interface 138 between the third dielectric portion 220 and the substrate 300. As depicted in FIGS. 9A and 9B, the second and third dielectric portions 218, 220 extend sideways outward from the first dielectric portion 204 in alignment with a signal feed slot 324, which not only serves to provide an additional attachment surface area between the dielectric structure 200 and the substrate 300, but also serves to ensure appropriate coverage of the signal feed slot 324 with the non-gaseous dielectric material 202 where from manufacturing variances there may be some slight misalignment of the various components or features of the EM device 100. In an embodiment, the first dielectric portion 204 has an overall outside dimension D as observed in the plan view of FIG. 9B, and the second and third dielectric portions 218, 220 extend sideways from the first dielectric portion 204 a distance d, where d is less than D. In an embodiment, d is equal to or less than 30% of D, or d is equal to or less than 15% of D. While the second and third dielectric portions 218, 220 are depicted in FIG. 9B as having a specific flat top profile, it will be appreciated that this is for illustration purposes only, and that said second and third dielectric portions 218, 220 may have any profile suitable for a purpose disclosed herein, such as a gradual transition profile from the first side 304 of the substrate 300 to the apex 224 of the dielectric structure 200, as represented by dashed lines 222. In an embodiment the height h of the second and third dielectric portions 218, 220 is less than the overall height H of the dielectric structure 200. In an embodiment, h is equal to or less than 30% of H, or h is equal to or less than 15% of H.

While the metallized structures 400 depicted in FIGS. 8A and 8B are depicted in relation to a certain dielectric structure 200, such as that similar to the dielectric structures 200 depicted in FIGS. 6A, 6B, 7A and 7B, it will be appreciated that such depiction is for illustration purposes only and is not intended to be limiting to the scope of the disclosure, as it is considered by the applicant that the same metallized structure 400 is equally applicable to any other dielectric structure 200 disclosed herein, such as those depicted in FIGS. 2B, 2C, 3B, 3C, 4A, 4B, 5B, 5C, 9A and 9B, for example.

In any of the foregoing embodiments, it will be appreciated that any signal feed structure known in the art suitable for a purpose disclosed herein may be implemented for electromagnetically exciting the dielectric structures 200 disclosed herein. That said, an embodiment disclosed herein includes an arrangement where the vias 302 having conductive interior walls 316 that are electrically connected between the first and second conductive layers 310, 312 forms a substrate integrated waveguide (SIW) 140, as depicted in FIG. 1. In an embodiment, the secondary vias 302.3 may be non-metal-plated so not to significantly disrupt the operation of the SIW 140.

Figure 10A:
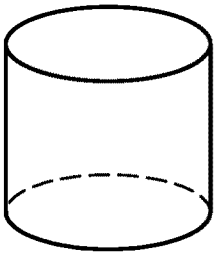
FIGS. 10A, 10B, 10C, 10D, 10E, 10F, 10G, 10H, 10I, and 10J depict example alternative of three dimensional shapes for a dielectric structure, in accordance with an embodiment.
Figure 10B:
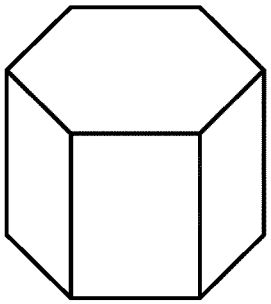
Figure 10C:
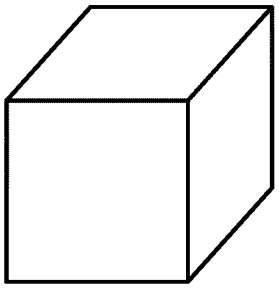
Figure 10D:
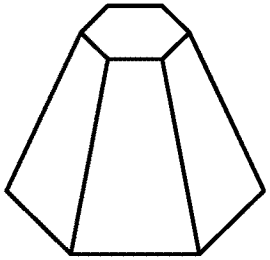
Figure 10E:
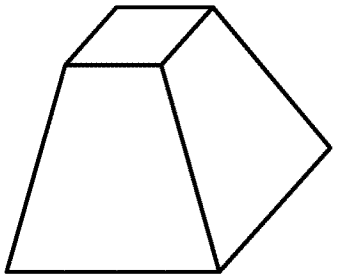
Figure 10F:
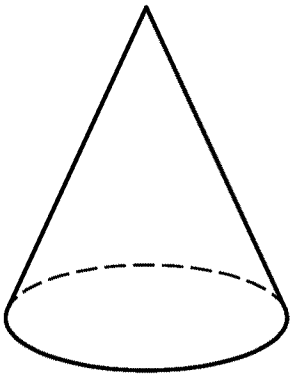
Figure 10G:
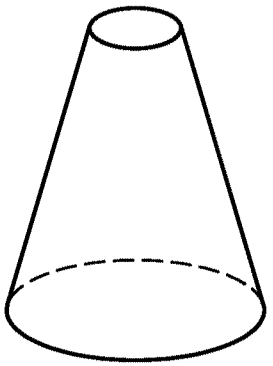
Figure 10H:
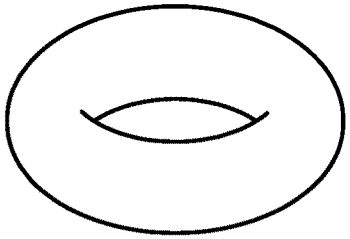
Figure 10I:
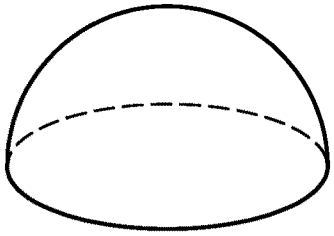
Figure 10J:
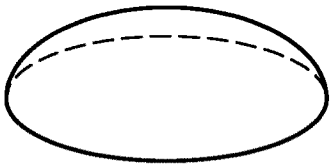
Figure 11A:
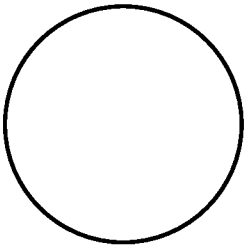
FIGS. 11A, 11B, 11C, 11D, and 11E depict example alternative z-axis cross sections for a dielectric structure, in accordance with an embodiment.
Figure 11B:
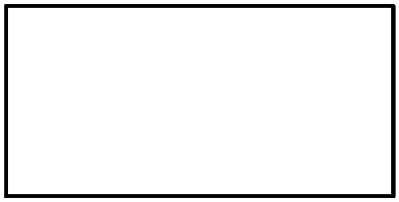
Figure 11C:
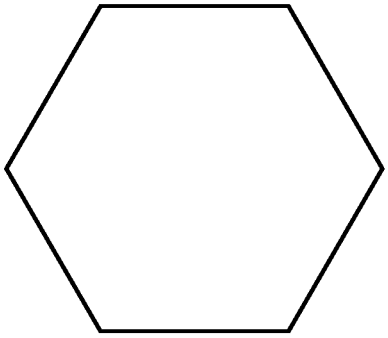
Figure 11D:
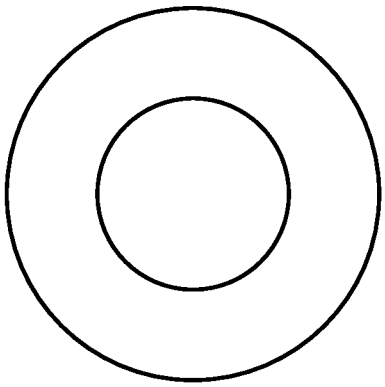
Figure 11E:
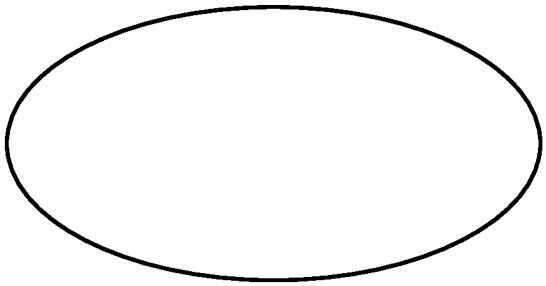

While the various dielectric structures 200 disclosed herein have a representative dome or hemispherical shape, and therefore a circular cross section relative to the z-axis, it will be appreciated that this is for illustration purposes only, and that other shapes for the dielectric structure 200 may be employed without detracting from a scope of the disclosure. For example and with reference to FIGS. 10A-11D, any dielectric structure 200 disclosed may have a three-dimensional form in the shape of a cylinder FIG. 10A, a polygon box FIGS. 10B, 10C, a tapered polygon box FIGS. 10D, 10E, a cone FIG. 10F, a truncated cone FIG. 10G, a toroid FIG. 10H, a dome FIG. 10I (for example, a half-sphere), an elongated dome FIG. 10J, or any other three-dimensional form suitable for a purpose disclosed herein, and therefore may have a z-axis cross section in the shape of a circle FIG. 11A, a rectangle FIG. 11B, a polygon FIG. 11C, a ring FIG. 11D, an ellipsoid 11E, or any other shape suitable for a purpose disclosed herein.

Figure 12A:
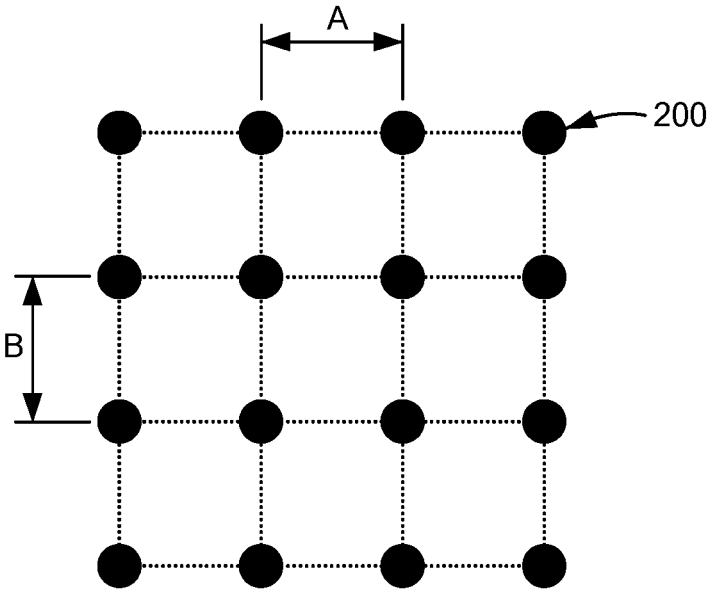
FIGS. 12A, 12B, 12C, 12D, 12E, 12F, and 12G depict example alternative arrays of dielectric structures 200, in accordance with an embodiment.
Figure 12B:
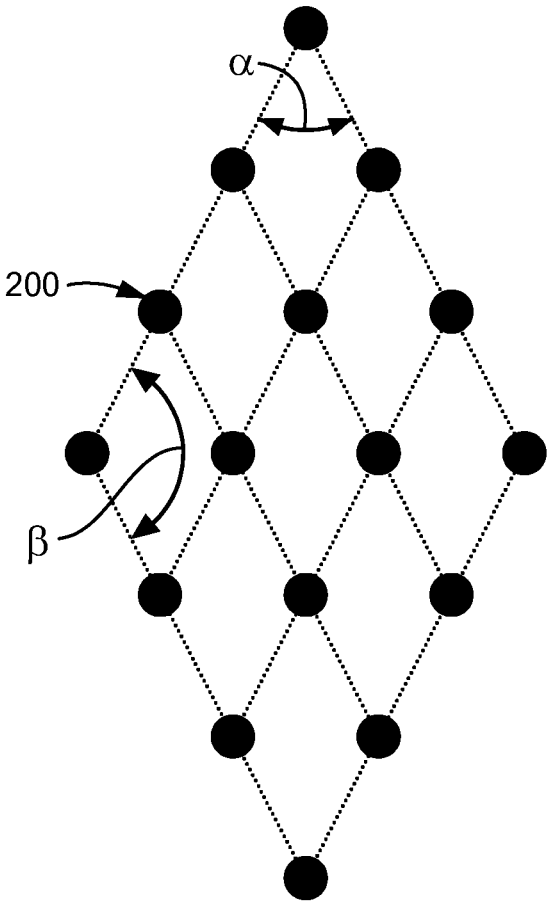
Figure 12C:
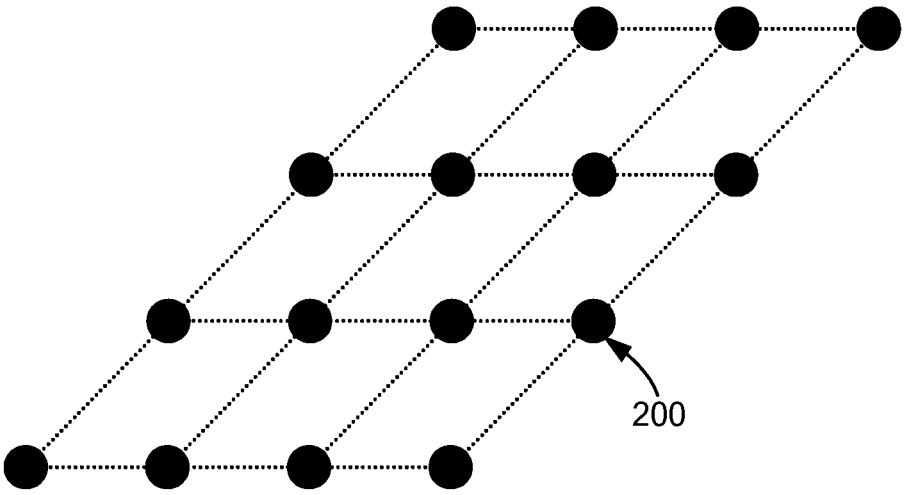
Figure 12D:
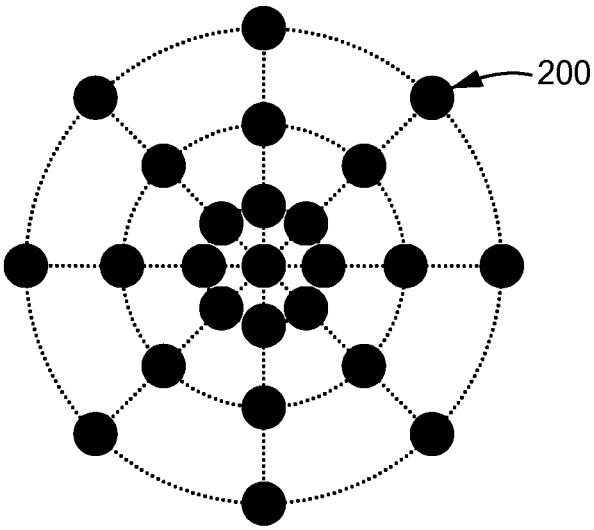
Figure 12E:
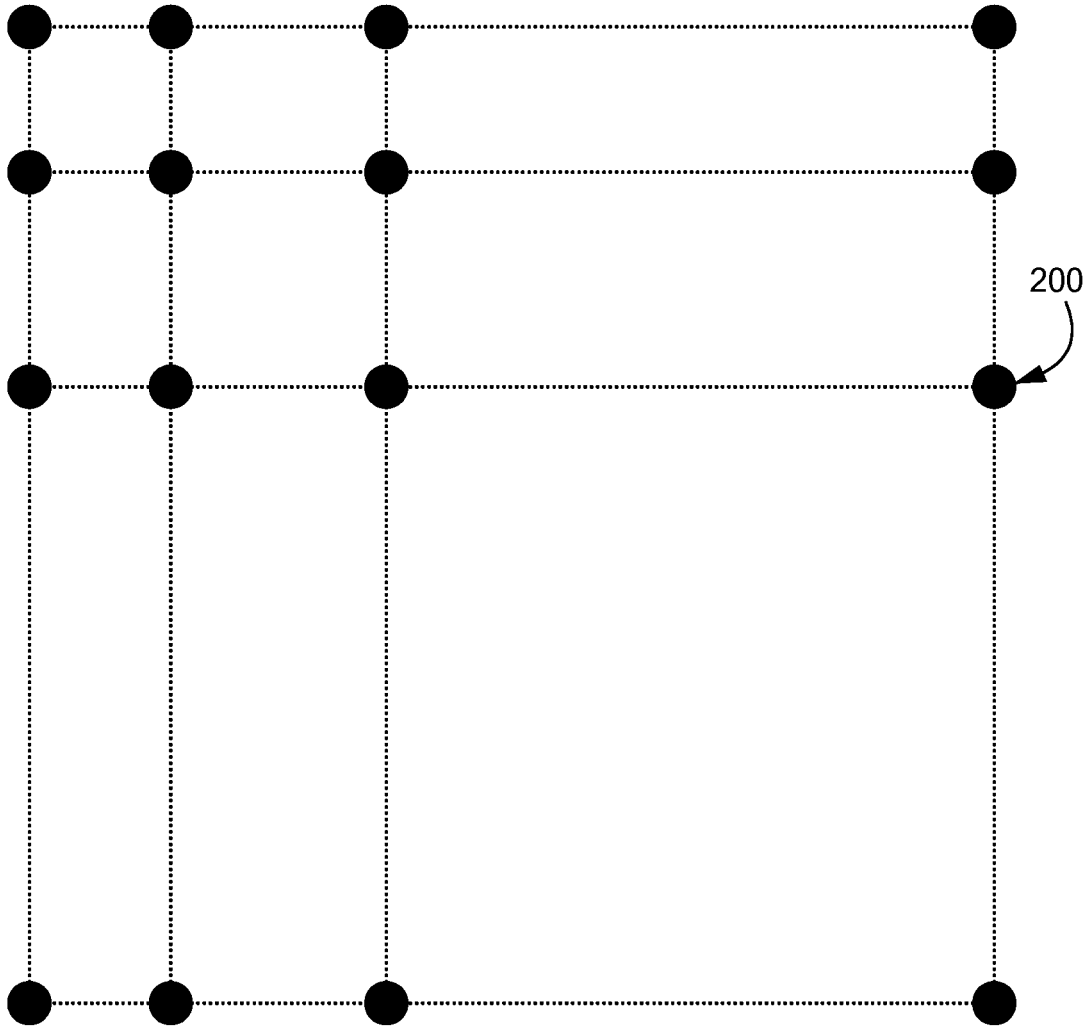
Figure 12F:
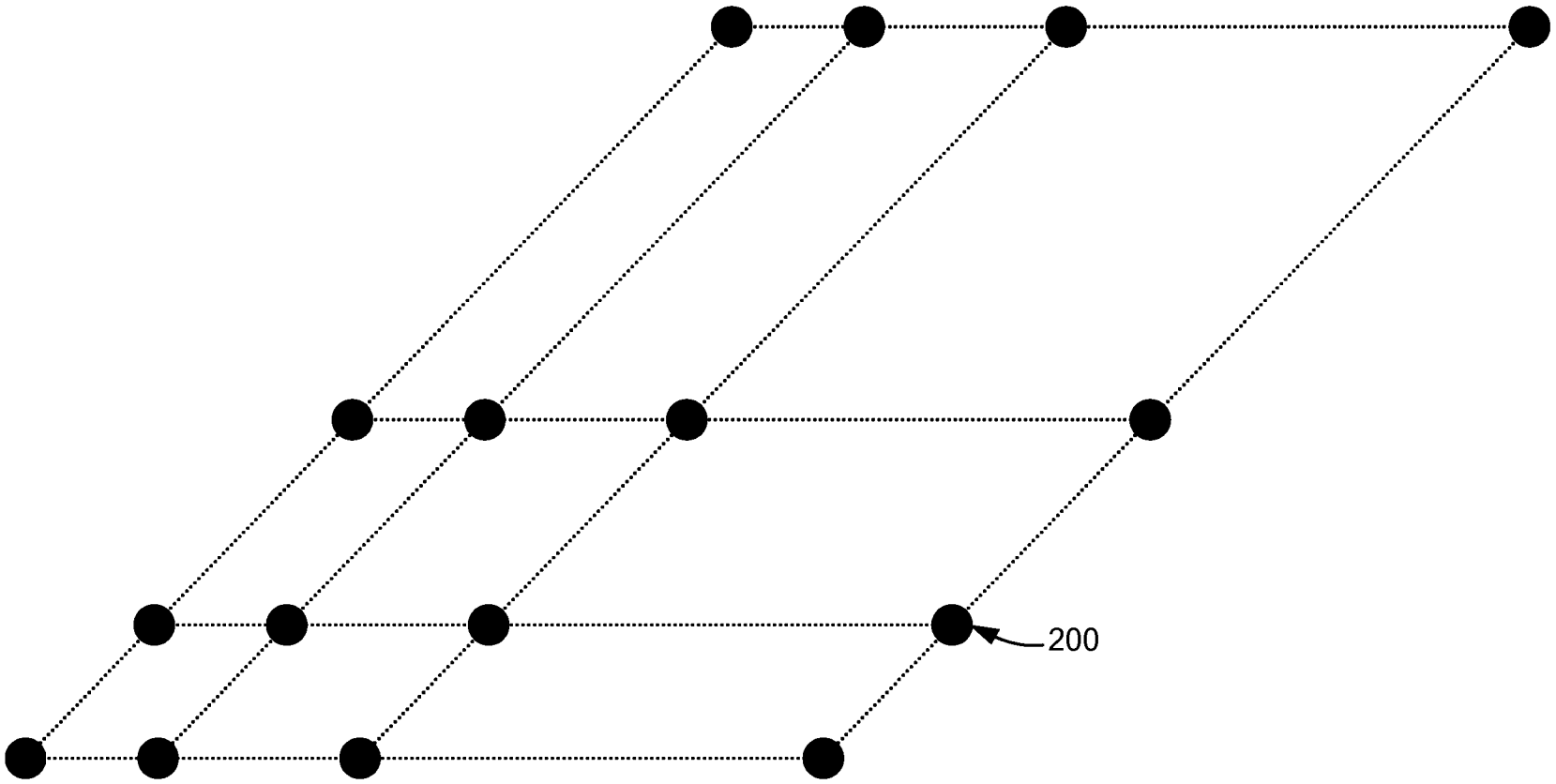
Figure 12G:
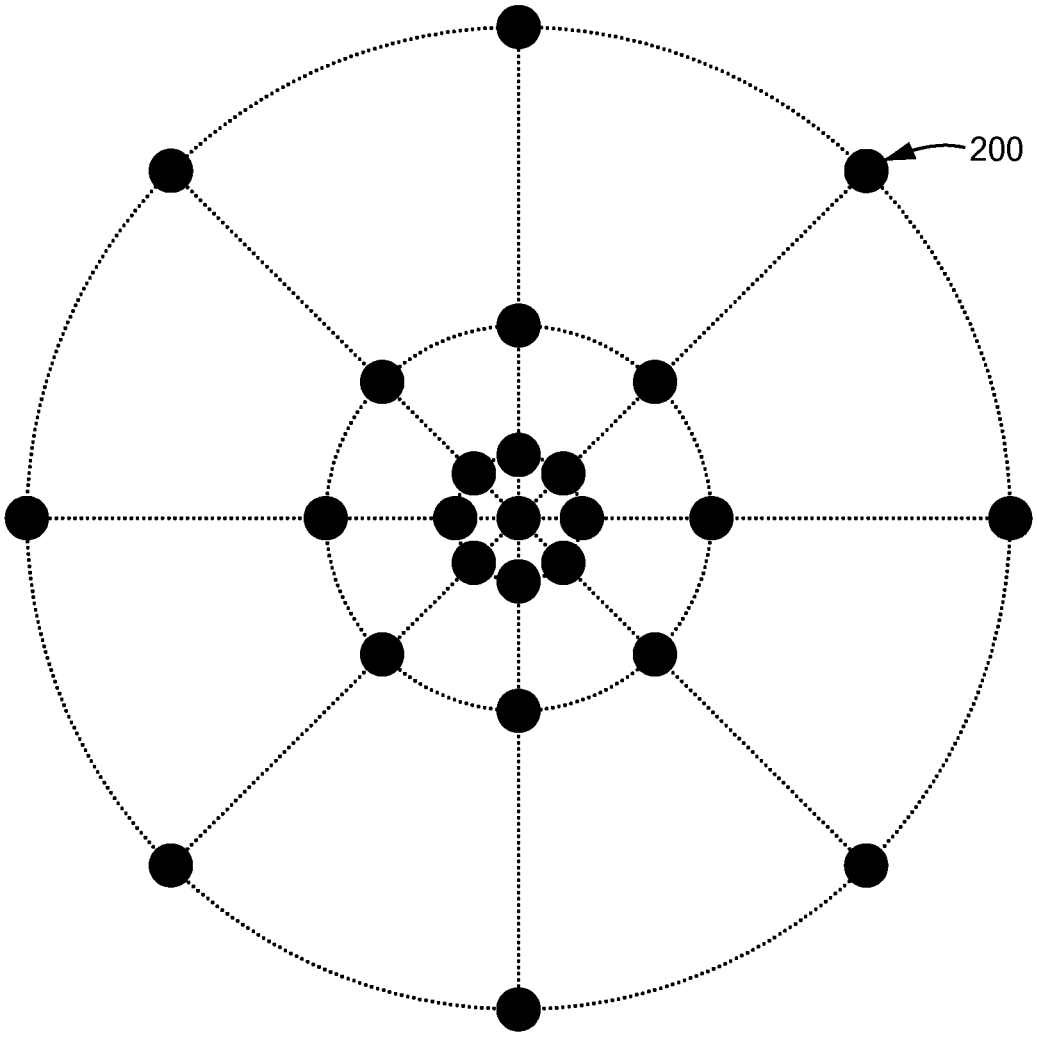

Additionally, and while FIG. 1 depicts an EM device 100 as an array of dielectric structures 200.1, 200.1, 200.3, 200.4 arranged in a certain manner, it will be appreciated that this is for illustration purposes only, and that other arrangements for the dielectric structures 200 may be employed without detracting from a scope of the disclosure. For example and with reference to FIGS. 12A-12G, a plurality of dielectric structures 200 may be arranged in an array with a center-to-center spacing between neighboring dielectric structures 200 in accordance with any of the following arrangements: equally spaced apart relative to each other in an x-y grid formation, where A=B (see FIG. 12A, for example); spaced apart in a diamond formation where the diamond shape of the diamond formation has opposing internal angles $\alpha<90$-degrees and opposing internal angles $\beta>90$-degrees (see FIG. 12B, for example); spaced apart relative to each other in a uniform periodic pattern (see FIGS. 12A, 12B, 12C, 12D, for example); spaced apart relative to each other in an increasing or decreasing non-periodic pattern (see FIGS. 12E, 12F, 12G, for example); spaced apart relative to each other on an oblique grid in a uniform periodic pattern (see FIG. 12C, for example); spaced apart relative to each other on a radial grid in a uniform periodic pattern (see FIG. 12D, for example); spaced apart relative to each other on an x-y grid in an increasing or decreasing non-periodic pattern (see FIG. 12E, for example); spaced apart relative to each other on an oblique grid in an increasing or decreasing non-periodic pattern (see FIG. 12F, for example); spaced apart relative to each other on a radial grid in an increasing or decreasing non-periodic pattern (see FIG. 12G, for example); spaced apart relative to each other on a non-x-y grid in a uniform periodic pattern (see FIGS. 12B, 12C, 12D, for example); spaced apart relative to each other on a non-x-y grid in an increasing or decreasing non-periodic pattern (see FIGS. 12F, 12G, for example). While various arrangements of the plurality of dielectric structures 200 are depicted herein, via FIGS. 12A-12G for example, it will be appreciated that such depicted arrangements are not exhaustive of the many arrangements that may be configured consistent with a purpose disclosed herein. As such, any and all arrangements of the plurality of dielectric structures 200 disclosed herein for a purpose disclosed herein are contemplated and considered to be within the ambit of the disclosure disclosed herein.

Molding processes such as insert molding to form structures on circuit substrates, such as printed circuit boards or silicon wafers, often result poor adhesion between the molded material and the substrate. However, for such applications, strong adhesion between the molded material and the underlying substrate is critical for achieving good electrical response. For example, injection molding of a dielectric structure 200 onto substrate 300 often results in delamination areas along the length scale of a few micrometers. It was found that the adhesion between the dielectric material of the dielectric structure and the conductive layer or between the dielectric material of the dielectric structure and the dielectric material of the dielectric layer can be increased by one or both of mechanical or chemical techniques. Mechanical techniques include mechanically interlocking the dielectric structure and at least one of the conductive layers and the dielectric layer utilizing a retrograde surface of a via. Chemical techniques include oxidizing a surface of the conductive layer or adding an adhesive layer. Another technique for increasing the adhesion includes roughening a surface of the conductive layer to increase the interfacial area between the dielectric structure and the conductive layer.

The dielectric structure 200 can be formed by injection molding, for example, by insert molding, a dielectric composition onto a substrate 300. In some embodiments, a plurality of the dielectric structures are injection molded onto a substrate 300, for example, comprising conductive layer 310 and dielectric layer 314. A combination of molding and other manufacturing methods can be used, for example, at least one of 3D printing or inkjet printing.

Injection molding allows the rapid and efficient manufacture of the dielectric structure onto the substrate. The injection molding can comprise placing the substrate into the mold located on the surface of the substrate and injection molding the dielectric composition into the mold.

The molding can comprise injection molding the dielectric composition comprising a thermoplastic polymer. The dielectric composition can be prepared by first combining a dielectric filler and an optional silane to form a filler composition and then mixing the filler composition with the thermoplastic polymer. For a thermoplastic polymer, the polymer can be melted prior to, after, or during the mixing with one or both of the dielectric filler. The dielectric composition can then be injection molded in the mold.

The melt temperature, the injection temperature, and the mold temperature can depend on the melt and glass transition temperature of the polymer. The melt temperature, the injection temperature, and the mold temperature can be greater than or equal to at least one of the melt and glass transition temperature of the polymer. At least one of the melt temperature, the injection temperature, or the mold temperature can be 40° C. to 220° C., or 40° C. to 160° C., or 100° C. to 220° C. One or both of the injection pressure and the holding pressure can be 65 to 350 kilopascal (kPa).

Ultrasonic waves can be used to assist injection molding. For example, ultrasonic waves can be focused into the dielectric composition or the substrate. The forces generated can result in at least one of an improvement in filler wetting, a reduction in viscosity of the dielectric composition, an improvement in compaction consistency, or an increase in the interfacial adhesion between the dielectric composition and the substrate.

Alternative to the use of ultrasonic waves, thermal energy may be used in place of ultrasonic waves to assist injection molding. For example, an associated substrate board may be preheated before overmolding or heating the dielectric composition and adhering the dielectric structures onto the substrate board.

It can take 0.1 to 10 seconds, or 0.5 to 5 seconds, or 0.2 to 1 second to fill the mold, during which time, the mold temperature can decrease. The mold can be filled at a rate of 0.25 to 3 cubic inches per second ($in^3$/sec). After the injecting, the dielectric composition can be in the mold for less than or equal to 10 minutes, or less than or equal to 2 minutes, or 2 to 30 seconds, or 0.5 to 10 minutes, or 0.5 to 5 minutes. After molding, the device can be removed at a decreased mold temperature.

A variety of variables can be modified to ensure good molding of the dielectric composition. For example, at least one of the following variables can be modified: the injection speed, the location of the nozzle during the injecting, a size of the nozzle, the viscosity of the dielectric composition, a molecular weight of the injection molded material (for example, of a thermoplastic polymer or an oligomer in a curable composition), a filler composition (for example, using a multimodal particle size), a temperature (for example, of the dielectric composition prior to molding, an injection temperature during molding, or a mold temperature of the mold), or a pressure.

Figure 13:
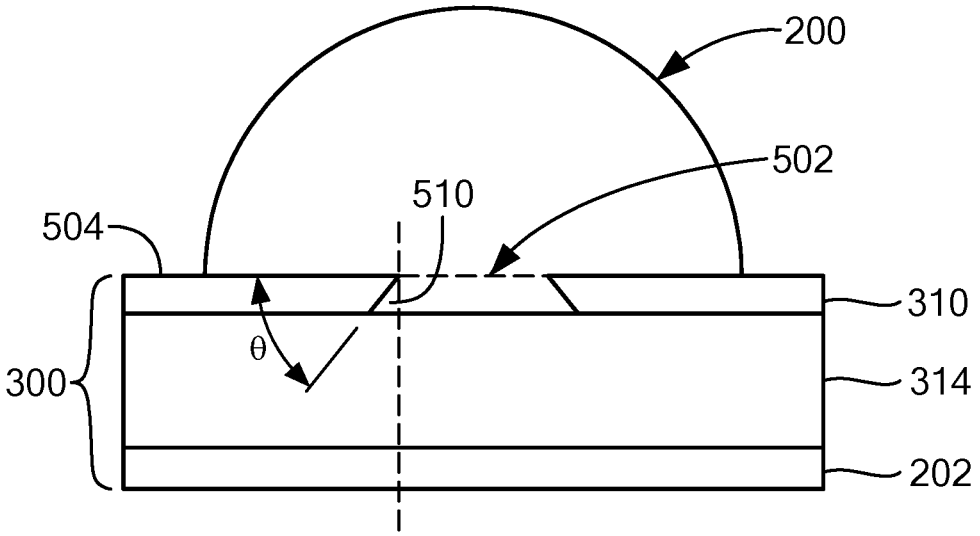
FIG. 13 depicts an example of an interlocking slot having a retrograde surface.

The conductive layer 310 can comprise an interlocking slot 510 having a retrograde surface. The retrograde surface of the interlocking slot can result in a mechanical interlocking between the dielectric structure 200 and the conductive layer 310. An example of an interlocking slot 510 with retrograde surface is illustrated in FIG. 13. As is illustrated in FIG. 13, a cross-sectional area of an upper opening 502 can have a smaller cross-sectional area than a cross-sectional area at a location along the depth of the interlocking slot 510. The upper opening is defined as the opening through which the dielectric composition enters during the injection molding.

The retrograde surface of the interlocking slot 510 can be linear along an angle θ of less than 90°, or 10 to 85°, or 45 to 80° with respect to the molding surface 504 of the substrate 300. The molding surface of the substrate refers to the surface on which the dielectric composition is injection molded. FIG. 13 illustrates an embodiment of linear retrograde surface. The retrograde surface can be non-linear, for example, having at least one of a convex or a concave surface. The retrograde surface can be jagged, for example, comprising a roughened surface or a plurality of protrusions extending into or out of the retrograde surface.

The retrograde surface can be formed by a variety of methods. For example, the retrograde surface can be formed by exposing an area of the first conductive layer 310 to an etchant, for example, by masking. The etching can be performed using a liquid etchant. The etching can be performed using a gas phase etchant, for example, by at least one of plasma etching, ion beam etching, or reactive ion etching. The etchant can etch isotropically, i.e., in both the lateral and vertical directions. An isotropic etchant (for example, chlorine gas or hydrogen chloride) can result in the formation of a linear retrograde surface or a concave retrograde surface.

Any of the aforementioned conductive layers, for example, conductive layer 310 and 312 independently, can comprise a conductive metal. The conductive metal can comprise at least one of copper, aluminum, silver, or gold. For example, the conductive metal can comprise copper or a copper alloy.

Prior to insert molding, an intermediate layer 122 can be formed on the conductive layer 310. Likewise, an intermediate layer can be formed on any exposed blind end 320 of the via 302. The intermediate layer 122 can comprise at least one of an oxide material (for example, at least one of a copper oxide or a black oxide), a nitride material, a layer of atomic deposition material, or a layer of vapor deposition material. The intermediate layer 122 can be formed by at least one of atomic deposition or vapor deposition. The intermediate layer 122 can be formed by exposing the conductive layer to an aqueous oxidizing solution comprising at least one of $HNO_3$, $H_2SO_4$, $AgNO_3$, $H_2O_2$, HOCl, KOCl, $KMnO_4$, or $CH_3COOH$. The oxidizing solution can comprise 2 to 95 vol %, or 5 to 80 vol % of the oxidizing agent based on the total volume of the oxidizing solution. The intermediate layer can have an increased roughness as compared to the conductive layer. The intermediate layer can comprise a roughness having an average peak to valley distance of 0.5 to 5 micrometers, or 1 to 5 micrometers, or 1 to 3 microcrometers. The average peak to valley distance can be determined using image analysis, for example, of an image obtained using scanning electron microscopy of a portion of the surface having an area of at least 20 micrometers squared. Other methods of determining the average peak to valley distance include optical profilometry and atomic force microscopy.

Prior to insert molding, a surface of the conductive layer, for example, molding surface 504 can be roughened by mechanical or chemical processes to form a roughened surface having an increased average peak to valley distance as compared to the initial surface. The average peak to valley distance can be greater than or equal to 5%, or greater than or equal to 10%, or 20 to 50% of the conductive layer thickness. This increase in the roughness can enable improved adhesion of the dielectric structure.

Prior to insert molding, an adhesive material 106 can be deposited onto a molding surface of the substrate, for example, onto at least one of the conductive layer 310, the intermediate layer 122, any exposed dielectric layer 314, or any exposed blind end of 320 of the via 302. The adhesive layer can be selected based on the desired properties, and can be, for example, a thermoset polymer having a low melting temperature or other composition for bonding two dielectric layers or a conductive layer to a dielectric layer. The adhesion layer can comprise a poly(arylene ether), a carboxy-functionalized polybutadiene or polyisoprene polymer comprising butadiene, isoprene, or butadiene and isoprene units, and zero to less than or equal to 50 wt % of co-curable monomer units. The adhesive composition of the adhesive layer can be different from the dielectric composition. The adhesive layer can be present in an amount of 2 to 15 grams per square meter. The poly(arylene ether) can comprise a carboxy-functionalized poly(arylene ether). The poly(arylene ether) can be the reaction product of a poly (arylene ether) and a cyclic anhydride or the reaction product of a poly(arylene ether) and maleic anhydride. The carboxy-functionalized polybutadiene or polyisoprene polymer can be a carboxy-functionalized butadiene-styrene copolymer. The carboxy-functionalized polybutadiene or polyisoprene polymer can be the reaction product of a polybutadiene or polyisoprene polymer and a cyclic anhydride. The carboxy-functionalized polybutadiene or polyisoprene polymer can be a maleinized polybutadiene-styrene or maleinized polyisoprene-styrene copolymer.

The adhesive layer can comprise a dielectric filler (e.g., ceramic particles) to adjust the dielectric constant thereof. For example, the dielectric constant of the adhesive layer can be adjusted to improve or otherwise modify the performance of the electromagnetic device (e.g., DRA devices).

The respective dielectric portions, for example, the dielectric structure 200 and the dielectric layer 314, can each independently comprise a dielectric material. A wide variety of dielectric materials can be used in any of the foregoing embodiments. The dielectric structure can comprise a thermoplastic polymer. The dielectric layer 314 can comprise at least one of a thermoplastic polymer or a thermoset polymer. The dielectric material can comprise a filler composition containing a dielectric filler (also referred to herein as the filler). Each dielectric material independently can comprise, based on the total volume of the dielectric material, 30 to 100 volume percent (vol %) of a polymer, and 0 to 70 vol % of a filler composition, or 30 to 99 vol % of a polymer and 1 to 70 vol % of a filler composition, or 50 to 95 vol % of a polymer and 5 to 50 vol % of a filler composition. The polymer and the filler can be selected to provide a dielectric material having a dielectric constant consistent for a purpose disclosed herein and a dissipation factor of less than 0.01, or less than or equal to 0.008 at 10 gigahertz (GHz). The dissipation factor can be measured by the IPC-TM-650 X-band strip line method or by the Split Resonator method.

The thermoplastic polymer can include oligomers, polymers, ionomers, dendrimers, copolymers (for example, graft copolymers, random copolymers, block copolymers (for example, star block copolymers and random copolymers)), and combinations comprising at least one of the foregoing. The thermoplastic polymer can be semi-crystalline or amorphous. The thermoplastic polymer can have a dielectric loss (also referred to as the dissipation factor) of less than or equal to 0.007, or less than or equal to 0.006, or 0.0001 to 0.007 at a frequency of 500 MHz to 100 GHz, or 500 MHz to 10 GHz at 23° C.

The thermoplastic polymer can comprise a polycarbonate, a polystyrene, a poly(phenylene ether), a polyimide (for example, polyetherimide), a polybutadiene, a polyacrylonitrile, a poly($C_{1-12}$alkyl)methacrylate (for example, polymethylmethacrylate (PMMA)), a polyester (for example, poly (ethylene terephthalate), poly(butylene terephthalate), polythioester), a polyolefin (for example, polypropylene (PP), high density polyethylene (HDPE), low density polyethylene (LDPE), linear low density polyethylene (LLDPE)), a polyamide (for example, polyamideimide), a polyarylate, a polysulfone (for example, polyarylsulfone, polysulfonamide), a poly(phenylene sulfide), a poly(phenylene oxide), a polyether (for example, poly(ether ketone) (PEK), poly(ether ether ketone) (PEEK), polyethersulfone (PES)), a poly(acrylic acid), a polyacetal, a polybenzoxazole (for example, polybenzothiazole, polybenzothiazinophenothiazine), a polyoxadiazole, a polypyrazinoquinoxaline, a polypyromellitimide, a polyquinoxaline, a polybenzimidazole, a polyoxindole, a polyoxoisoindoline (for example, polydioxoisoindoline), a polytriazine, a polypyridazine, a polypiperazine, a polypyridine, a polypiperidine, a polytriazole, a polypyrazole, a polypyrrolidine, a polycarborane, a polyoxabicyclononane, a polydibenzofuran, a polyphthalide, a polyacetal, a polyanhydride, a vinyl polymer (for example, a poly(vinyl ether), a poly(vinyl thioether), a poly(vinyl alcohol), a poly(vinyl ketone), a poly(vinyl halide) (for example, poly(vinyl chloride)), a poly(vinyl nitrile), a poly(vinyl ester)), a polysulfonate, a polysulfide, a polyurea, a polyphosphazene, a polysilazane, a polysiloxane, or a combination comprising at least one of the foregoing. The thermoplastic polymer can comprise a poly (aryl)etherketone (for example, poly(ether ketone), poly (ether ether ketone), and poly(ether ketone ketone)), a polysulfone (a, for example, poly(ether sulfone)), a poly (phenylene sulfide), a poly(ether imide), a poly(amide imide), or a combination comprising at least one of the foregoing. The thermoplastic polymer can comprise a polyolefin. The thermoplastic polymer can comprise a combination comprising at least one of the foregoing polymers.

The thermoplastic polymer can comprise a poly(aryl) etherketone, for example, poly(ether ketone), poly(ether ether ketone), and poly(ether ketone ketone). For example, the thermoplastic polymer can comprise poly(ether ether ketone). The poly(ether ether ketone) can have a melt flow rate (MRF) of 40 to 50 grams per 10 minutes (g/10 min) as determined in accordance with ASTM D1238-13, Procedure A, at a load of 2.16 kilograms (kg) at 400° C.

The thermoplastic polymer can comprise a polyolefin. The polyolefin can comprise a low density polyethylene. The polyolefin can comprise a cyclic olefin copolymer (for example, a copolymerization product of norbornene and ethylene using a metallocene catalyst), optionally in combination with a linear polyolefin. The cyclic olefin copolymer can have one or more of a tensile strength at yield of 40 to 50 megapascal (MPa) at 5 millimeters per minute (mm/min) as measured in accordance with ISO 527-2/1A:2012; a dielectric constant of 2 to 2.5 at a frequency of 1 to 10 kilohertz (kHz) as determined in accordance with IEC 60250; and a heat deflection temperature of greater than or equal to 125° C., for example, 135 to 160° C. at 0.46 MPa, as determined in accordance with ISO 75-1,-2:2004.

The dielectric material can comprise a liquid crystalline polymer. Liquid crystalline polymers (sometimes abbreviated as "LCP") are a class of polymers well known for a variety of uses. Liquid crystalline polymers often comprise thermoplastic resins, although they can also be used as thermosets by functionalization or by compounding with a thermoset, for example, an epoxy. Liquid crystalline polymers are believed to have a fixed molecular shape (for example, linear) due to the nature of the repeating units in the polymeric chain. The repeating units typically comprise rigid molecular elements. The rigid molecular elements (mesogens) are frequently rod-like or disk-like in shape and are typically aromatic and frequently heterocyclic. The rigid molecular elements can be present in one or both of the main chain (backbone) of the polymer and in the side chains. The rigid molecular elements can be separated by more flexible molecular elements, sometimes referred to as spacers.

Examples of commercial liquid crystalline polymers include, but are not limited to VECTRA™, commercially available from Celanese, XYDAR™, commercially available from Solvay, and ZENITE™, commercially available from Celanese, and those available from RTP Co., for example, the RTP-3400 series liquid crystalline polymers.

The dielectric material can comprise at least one of 1,2-polybutadiene (PBD), polyisoprene, polybutadiene-polyisoprene copolymers, polyetherimide (PEI), fluoropolymers such as polytetrafluoroethylene (PTFE), polyimide, polyetheretherketone (PEEK), polyamidimide, polyethylene terephthalate (PET), polyethylene naphthalate, polycyclohexylene terephthalate, or polyphenylene ethers such as those based on allylated polyphenylene ethers. Combinations of low polarity polymers with higher polarity polymers can also be used, non-limiting examples including epoxy and poly(phenylene ether), epoxy and poly(etherimide), cyanate ester and poly(phenylene ether), or 1,2-polybutadiene and polyethylene.

The dielectric layer 314 can comprise a fluoropolymer, for example, polyvinyl fluoride (PVF), polyvinylidene fluoride (PVDF), fluorinated ethylene-propylene (FEP), polytetrafluoroethylene (PTFE), or polyethylenetetrafluoroethylene (PETFE). Fluoropolymers include fluorinated homopolymers, e.g., PTFE and polychlorotrifluoroethylene (PCTFE), and fluorinated copolymers, e.g. copolymers of tetrafluoroethylene or chlorotrifluoroethylene with a monomer such as hexafluoropropylene or perfluoroalkylvinylethers, vinylidene fluoride, vinyl fluoride, ethylene, or a combination comprising at least one of the foregoing. The fluoropolymer can comprise a combination of different at least one of these fluoropolymers.

The dielectric layer 314 can comprise thermoset polybutadiene or polyisoprene. As used herein, the term "thermosetting polybutadiene or polyisoprene" includes homopolymers and copolymers comprising units derived from butadiene, isoprene, or combinations thereof. Units derived from other copolymerizable monomers can also be present in the polymer, for example, in the form of grafts. Exemplary copolymerizable monomers include, but are not limited to, vinylaromatic monomers, for example, substituted and unsubstituted monovinylaromatic monomers such as styrene, 3-methylstyrene, 3,5-diethylstyrene, 4-n-propylstyrene, alpha-methylstyrene, alpha-methyl vinyltoluene, para-hydroxystyrene, para-methoxystyrene, alpha-chlorostyrene, alpha-bromostyrene, dichlorostyrene, dibromostyrene, tetra-chlorostyrene, and the like; and substituted and unsubstituted divinylaromatic monomers such as divinylbenzene, divinyltoluene, and the like. Combinations comprising at least one of the foregoing copolymerizable monomers can also be used. Exemplary thermosetting polybutadiene or polyisoprenes include, but are not limited to, butadiene homopolymers, isoprene homopolymers, butadiene-vinylaromatic copolymers such as butadiene-styrene, isoprene-vinylaromatic copolymers such as isoprene-styrene copolymers, and the like.

The thermosetting polybutadiene or polyisoprene can also be modified. For example, the polymers can be hydroxyl-terminated, methacrylate-terminated, carboxylate-terminated, or the like. Post-reacted polymers can be used such as epoxy-, maleic anhydride-, or urethane-modified polymers of butadiene or isoprene polymers. The polymers can also be crosslinked, for example, by divinylaromatic compounds such as divinyl benzene, e.g., a polybutadiene-styrene cross-linked with divinyl benzene. Exemplary materials are broadly classified as "polybutadienes" by their manufacturers, for example, Nippon Soda Co., Tokyo, Japan, and Cray Valley Hydrocarbon Specialty Chemicals, Exton, Pa. Combinations can also be used, for example, a combination of a polybutadiene homopolymer and a poly(butadiene-isoprene) copolymer. Combinations comprising a syndiotactic polybutadiene can also be used.

The thermosetting polybutadiene or polyisoprene can be liquid or solid at room temperature. The liquid polymer can have a number average molecular weight (Mn) of greater than or equal to 5,000 g/mol. As used herein the number average molecular weight can be based on polystyrene standards. The liquid polymer can have an Mn of less than 5,000 g/mol, or 1,000 to 3,000 g/mol. Thermosetting polybutadiene or polyisoprene having at least 90 wt % 1,2 addition, can exhibit greater crosslink density upon cure due to the large number of pendent vinyl groups available for crosslinking.

The polybutadiene or polyisoprene can be present in the dielectric material in an amount of up to 100 wt %, or up to 75 wt % with respect to the total dielectric material, more specifically, 10 to 70 wt %, or 20 to 60 or 70 wt %, based on the total weight of the dielectric material.

Other polymers that can co-cure with the thermosetting polybutadiene or polyisoprene can be added for specific property or processing modifications. For example, in order to improve the stability of the dielectric strength and mechanical properties of the dielectric material over time, a lower molecular weight ethylene-propylene elastomer can be used in the systems. An ethylene-propylene elastomer as used herein is a copolymer, terpolymer, or other polymer comprising primarily ethylene and propylene. Ethylene-propylene elastomers can be further classified as EPM copolymers (i.e., copolymers of ethylene and propylene monomers) or EPDM terpolymers (i.e., terpolymers of ethylene, propylene, and diene monomers). Ethylene-propylene-diene terpolymer rubbers, in particular, have saturated main chains, with unsaturation available off the main chain for facile cross-linking. Liquid ethylene-propylene-diene terpolymer rubbers, in which the diene is dicyclopentadiene, can be used.

The molecular weights of the ethylene-propylene rubbers can be less than 10,000 g/mol viscosity average molecular weight (Mv). The ethylene-propylene rubber can include an ethylene-propylene rubber having an Mv of 7,200 g/mol, which is available from Lion Copolymer, Baton Rouge, La., under the trade name TRILENE™ CP80; a liquid ethylene-propylene-dicyclopentadiene terpolymer rubbers having an Mv of 7,000 g/mol, which is available from Lion Copolymer under the trade name of TRILENE™ 65; and a liquid ethylene-propylene-ethylidene norbornene terpolymer having an Mv of 7,500 g/mol, which is available from Lion Copolymer under the name TRILENE™ 67.

The ethylene-propylene rubber can be present in an amount effective to maintain the stability of the properties of the dielectric material over time, in particular the dielectric strength and mechanical properties. Typically, such amounts are up to 20 wt % with respect to the total weight of the dielectric material, specifically, 4 to 20 wt %, or 6 to 12 wt %.

Another type of co-curable polymer is an unsaturated polybutadiene- or polyisoprene-containing elastomer. This component can be a random or block copolymer of primarily 1,3-addition butadiene or isoprene with an ethylenically unsaturated monomer, for example, a vinylaromatic compound such as styrene or alpha-methyl styrene, an acrylate or methacrylate such a methyl methacrylate, or acrylonitrile. The elastomer can be a solid, thermoplastic elastomer comprising a linear or graft-type block copolymer having a polybutadiene or polyisoprene block and a thermoplastic block that can be derived from a monovinylaromatic monomer such as styrene or alpha-methyl styrene. Block copolymers of this type include styrene-butadiene-styrene triblock copolymers, for example, those available from Dexco Polymers, Houston, Tex. under the trade name VECTOR 8508M™, from Enichem Elastomers America, Houston, Tex. under the trade name SOL-T-6302™, and those from Dynasol Elastomers under the trade name CALPRENE™401; and styrene-butadiene diblock copolymers and mixed triblock and diblock copolymers containing styrene and butadiene, for example, those available from Kraton Polymers (Houston, Tex.) under the trade name KRATON D1118. KRATON D1118 is a mixed diblock/triblock styrene and butadiene containing copolymer that contains 33 wt % styrene.

The optional polybutadiene- or polyisoprene-containing elastomer can further comprise a second block copolymer similar to that described above, except that the polybutadiene or polyisoprene block is hydrogenated, thereby forming a polyethylene block (in the case of polybutadiene) or an ethylene-propylene copolymer block (in the case of polyisoprene). When used in conjunction with the above-described copolymer, materials with greater toughness can be produced. An exemplary second block copolymer of this type is KRATON GX1855 (commercially available from Kraton Polymers, which is believed to be a combination of a styrene-high 1,2-butadiene-styrene block copolymer and a styrene-(ethylene-propylene)-styrene block copolymer.

The unsaturated polybutadiene- or polyisoprene-containing elastomer component can be present in the dielectric material in an amount of 2 to 60 wt % with respect to the total weight of the dielectric material, specifically, 5 to 50 wt %, or 10 to 40 or 50 wt %.

Still other co-curable polymers that can be added for specific property or processing modifications include, but are not limited to, homopolymers or copolymers of ethylene such as polyethylene and ethylene oxide copolymers, natural rubber; norbornene polymers such as polydicyclopentadiene; hydrogenated styrene-isoprene-styrene copolymers and butadiene-acrylonitrile copolymers; unsaturated polyesters; and the like. Levels of these copolymers are generally less than 50 wt % of the total polymer in the dielectric material.

Free radical-curable monomers can also be added for specific property or processing modifications, for example, to increase the crosslink density of the system after cure. Exemplary monomers that can be suitable crosslinking agents include, for example, at least one of di, tri-, or higher ethylenically unsaturated monomers such as divinyl benzene, triallyl cyanurate, diallyl phthalate, or multifunctional acrylate monomers (e.g., SARTOMER™ polymers available from Sartomer USA, Newtown Square, Pa., business under Arkema Group), all of which are commercially available. The crosslinking agent, when used, can be present in the dielectric composition in an amount of up to 20 wt %, or 1 to 15 wt %, based on the total weight of the dielectric composition.

A curing agent can be added to the dielectric composition to accelerate the curing reaction of polyenes having olefinic reactive sites. Curing agents can comprise organic peroxides, for example, dicumyl peroxide, t-butyl perbenzoate, 2,5-dimethyl-2,5-di(t-butyl peroxy)hexane, α,α-di-bis(t-butyl peroxy)diisopropylbenzene, 2,5-dimethyl-2,5-di(t-butyl peroxy) hexyne-3, or a combination comprising at least one of the foregoing. Carbon-carbon initiators, for example, 2,3-dimethyl-2,3 diphenylbutane can be used. Curing agents or initiators can be used alone or in combination. The amount of curing agent can be 1.5 to 10 wt % based on the total weight of the polymer in the dielectric composition.

In some embodiments, the polybutadiene or polyisoprene polymer is carboxy-functionalized. Functionalization can be accomplished using a polyfunctional compound having in the molecule both (i) a carbon-carbon double bond or a carbon-carbon triple bond, and (ii) at least one of a carboxy group, including a carboxylic acid, anhydride, amide, ester, or acid halide. A specific carboxy group is a carboxylic acid or ester. Examples of polyfunctional compounds that can provide a carboxylic acid functional group include at least one of maleic acid, maleic anhydride, fumaric acid, or citric acid. In particular, polybutadienes adducted with maleic anhydride can be used in the thermosetting composition. Suitable maleinized polybutadiene polymers are commercially available, for example, from Cray Valley under the trade names RICON 130MA8, RICON 130MA13, RICON 130MA20, RICON 131MA5, RICON 131MA10, RICON 131MA17, RICON 131MA20, and RICON 156MA17. Suitable maleinized polybutadiene-styrene copolymers are commercially available, for example, from Sartomer under the trade names RICON 184MA6. RICON 184MA6 is a butadiene-styrene copolymer adducted with maleic anhydride having styrene content of 17 to 27 wt % and Mn of 9,900 g/mol.

At least one of the dielectric layer and the dielectric structure can comprise a filler composition that can be selected to adjust at least one of the dielectric constant, dissipation factor, or coefficient of thermal expansion. The filler composition can comprise at least one dielectric filler, for example, at least one of titanium dioxide (rutile and anatase), barium titanate, strontium titanate, silica (including fused amorphous silica), corundum, wollastonite, $Ba_2Ti_9O_{20}$, solid glass spheres, synthetic glass or ceramic hollow spheres, quartz, boron nitride, aluminum nitride, silicon carbide, beryllia, alumina, alumina trihydrate, magnesia, mica, talcs, nanoclays, or magnesium hydroxide. The dielectric filler can be at least one of particulate, fibers, or whiskers.

The filler composition can have a multimodal particle size distribution, wherein a peak of a first mode of the multimodal particle size distribution is at least seven times that of a peak of a second mode of the multimodal particle size distribution. The multimodal particle size distribution can be, for example, bimodal, trimodal, or quadramodal. In other words, the filler composition can comprise a first plurality of particles having a first average particle size and a second plurality of particles having a second average particle size; wherein the first average particle size is greater than or equal to 7 times, or greater than or equal to 10 times, or 7 to 20 times the second average particle size. As used herein, the term particle size refers to a diameter of a sphere having the same volume as the particle and the average particle size refers to a number average of the particle sizes of the plurality of particles. The first plurality of particles and the second plurality of particles can comprise the same dielectric filler. For example, first plurality of particles and the second plurality of particles can comprise titanium dioxide. Conversely, the first plurality of particles and the second plurality of particles can comprise different dielectric fillers. For example, the first plurality of particles can comprise silica and the second plurality of particles can comprise titanium dioxide.

The first plurality of particles can have an average particle size of 1 to 10 micrometers, or 2 to 5 micrometers. The second plurality of particles can have an average particle size of 0.01 to 1 micrometer, or 0.1 to 0.5 micrometers. The dielectric filler can comprise a first plurality of particles comprising titanium dioxide having an average particle size of 1 to 10 micrometers and a second plurality of particles having an average particle size of 0.1 to 1 micrometer.

The dielectric material can comprise 10 to 90 vol %, or 20 to 80 vol %, or 30 to 80 vol %, or 40 to 80 vol % of the dielectric filler based on the total volume of the dielectric material. The dielectric material can comprise 25 to 45 vol %, or 30 to 40 vol % of the first plurality of particles and 10 to 25 vol %, or 10 to 20 vol % of the second plurality of particles; both based on the total volume of the dielectric material. The dielectric filler can comprise 10 to 90 vol %, or 50 to 90 vol %, or 60 to 80 vol % of the first plurality of particles based on the total volume of the dielectric filler. The dielectric filler can comprise 10 to 90 vol %, or 10 to 50 vol %, or 20 to 40 vol % of the second plurality of particles based on the total volume of the dielectric filler.

The dielectric material can comprise a flow modifier. The flow modifier can comprise a ceramic filler. The ceramic filler can comprise one or more of the dielectric fillers listed herein provided that it is different from the dielectric filler. For example, the dielectric filler can comprise titanium dioxide and the ceramic filler can comprise boron nitride. The flow modifier can comprise a fluoropolymer (for example, PFPE), for example, FLUOROGARD™ commercially available from Chemours USA Fluoroproducts, Wilmington, Del. The flow modifier can comprise a polyhedral oligomeric silsesquioxane (commonly referred to as "POSS", also referred to herein as the "silsesquioxane"). The flow modifier can comprise a combination comprising one or more of the foregoing flow modifiers. The flow modifier can be present in an amount of less than or equal to 5 vol %, or 0.5 to 5 vol %, or 0.5 to 2 vol % based on the total volume of the dielectric material. At these low concentrations, the dielectric constant of the dielectric material will not be significantly affected.

The flow modifier can comprise the silsesquioxane. The silsesquioxane is a nano-sized inorganic material with a silica core that can have reactive functional groups on the surface. The silsesquioxane can have a cube or a cube-like structure comprising silicon atoms at the vertices and interconnecting oxygen atoms. Each of the silicon atoms can be covalently bonded to a pendent R group. Silsesquioxanes, for example, octa(dimethylsiloxy) silsesquioxane ($R_8Si_8O_{12}$), comprise a cage of silicon and oxygen atoms around a core with eight pendent R groups. Each R group independently can be a hydrogen, a hydroxy group, an alkyl group, an aryl group, or an alkene group, where the R group can comprise one to twelve carbon atoms and one or more heteroatoms (for example, oxygen, nitrogen, phosphorus, silicon, a halogen, or a combination comprising at least one of the foregoing). Each R group independently can comprise a reactive group, for example, an alcohol, an epoxy group, an ester, an amine, a ketone, an ether, a halide, or a combination comprising at least one of the foregoing. Each R group independently can comprise a silanol, an alkoxide, a chloride, or a combination comprising at least one of the foregoing. The silsesquioxane can comprise trisilanolphenyl POSS, dodecaphenyl POSS, octaisobutyl POSS, octamethyl POSS, or a combination comprising at least one of the foregoing. The silsesquioxane can comprise trisilanolphenyl POSS.

Optionally, one or more of the fillers can be surface treated with a silicon-containing coating, for example, an organofunctional alkoxy silane coupling agent. A zirconate or titanate coupling agent can be used. Such coupling agents can improve the dispersion of the filler in the dielectric material and can reduce water absorption of the finished DRA. The filler component can comprise 5 to 50 vol % of the microspheres and 70 to 30 vol % of fused amorphous silica as secondary filler based on the weight of the filler composition.

Each dielectric material independently can optionally contain one or more flame retardants useful for making the dielectric material resistant to flame. These flame retardants can be halogenated or unhalogenated. The flame retardants can be present in the dielectric layer in an amount of 0 to 30 vol % based on the volume of the dielectric material.

In an embodiment, the flame retardant is inorganic and is present in the form of particles. An exemplary inorganic flame retardant is a metal hydrate, having, for example, a volume average particle diameter of 1 nm to 500 nm, or 1 to 200 nm, or 5 to 200 nm, or 10 to 200 nm; alternatively the volume average particle diameter is 500 nm to 15 micrometer, for example, 1 to 5 micrometer. The metal hydrate is a hydrate of a metal such as Mg, Ca, Al, Fe, Zn, Ba, Cu, Ni, or a combination comprising at least one of the foregoing. Hydrates of Mg, Al, or Ca are particularly preferred, for example, at least one of aluminum hydroxide, magnesium hydroxide, calcium hydroxide, iron hydroxide, zinc hydroxide, copper hydroxide or nickel hydroxide; or hydrates of calcium aluminate, gypsum dihydrate, zinc borate, or barium metaborate. Composites of these hydrates can be used, for example, a hydrate containing Mg and at least one of Ca, Al, Fe, Zn, Ba, Cu, or Ni. A preferred composite metal hydrate has the formula $MgMx.(OH)_y$ wherein M is Ca, Al, Fe, Zn, Ba, Cu, or Ni, x is 0.1 to 10, and y is from 2 to 32. The flame retardant particles can be coated or otherwise treated to improve dispersion and other properties.

Organic flame retardants can be used, alternatively or in addition to the inorganic flame retardants. Examples of organic flame retardants include melamine cyanurate, fine particle size melamine polyphosphate, various other phosphorus-containing compounds such as aromatic phosphinates, diphosphinates, phosphonates, and phosphates, certain polysilsesquioxanes, siloxanes, and halogenated compounds such as hexachloroendomethylenetetrahydrophthalic acid (HET acid), tetrabromophthalic acid and dibromoneopentyl glycol A flame retardant (such as a bromine-containing flame retardant). Examples of brominated flame retardants include Saytex BT93W (ethylene bistetrabromophthalimide), Saytex 120 (tetradecabromodiphenoxy benzene), and Saytex 102 (decabromodiphenyl oxide).

The flame retardant can be present in an amount of 20 phr (parts per hundred parts of resin) to 60 phr, or 30 to 45 phr. The flame retardant can be used in combination with a synergist, for example a halogenated flame retardant can be used in combination with a synergist such as antimony trioxide, and a phosphorus-containing flame retardant can be used in combination with a nitrogen-containing compound such as melamine.

Supplemental to the foregoing, a dielectric structure as disclosed herein may be secured to a substrate by direct thermal melt bonding either concurrent with the structure forming (thermoplastic injection molding for example) or post structure forming (application of heat/pressure or ultrasonic energy/pressure for example).

In an effort to maximize bond adhesion at an interfacial contact area, it may be advantageous to use a primer or an adhesive in combination with the above bonding methods. A primer changes the surface characteristics of the substrate at minimal thicknesses (angstrom to sub-micrometer). The purpose of the primer is to change the chemistry at the substrate surface to allow for better coupling (covalent bonding) or compatibility between the dielectric structure and the substrate. Due to the minimal thickness of a primer, there is also minimal flow and gap filling capability. An adhesive performs essentially the same function as a primer but in a thicker layer to allow for flow and gap filling capability.

Because of the primer's minimal thickness, there is less need to match the dielectric properties of the dielectric structure. Conversely, the adhesive's greater thickness may require greater attention to matching the dielectric properties of the dielectric structure to avoid reductions in final assembly performance.

Primers can be small, reactive molecules such as silanes, zirconates and titanates, and are known in the industry as being available as Dynasylan from Evonik Industries AG, Essen, Germany or Ken-React from Kenrich Petrochemicals, Bayonne, N.J., USA. They can be larger molecules, either oligomeric or polymeric with their applied thickness determined by the solids content of the solvent borne solution they are applied from. Oligomeric primers can include reactive functionalities such as vinyl unsaturation, which in the presence of heat and a free radical initiator can chain extend or crosslink to high molecular weight. Suitable oligomers include vinyl terminated polyphenylene ether available as Noryl from SABIC, Selkirk, N.Y., USA and butadiene-styrene copolymers available as Ricon from Cray Valley/Total Petrochemicals, Exton, Pa., USA. Polymeric primer chains will soften when exposed to temperatures above their glass transition temperatures and can help with surface smoothness, which will minimize air entrapment.

Adhesives can be thicker applications of formulated oligomers as above or more preferably, solubilized high polymers. Further, combinations of reactive oligomers and non-reactive polymers can be used with a free radical initiator and optionally a reactive co-agent to maximize the oligomer crosslinking. The high polymer adhesive material may be chosen to match the polarity and solubility parameter of the dielectric structure resinous component in order to maximize compatibility. Alternatively, acid-base pairs may be used (example: anhydride-amine) if they show no deterioration of the assembly performance. Thermoplastic resins that are soluble and soften, flow and adhere, include: polyetherimide copolymers available as Ultem from Sabic, Selkirk, N.Y., USA; polyimides available as Polyimide P84NT from Evonik Industries AG, Essen, Germany; fluorinated polyimides available as CP1 from NeXolve, Huntsville, Ala., USA. Materials with glass transition temperatures above 260C may be more suitable for assemblies that may require further solder processing. Thicker bond lines necessary for flow and gap filling may require better matching of the dielectic properties of the adhesive to the dielectric structure. Fillers suitable for the dielectric structure may be used for the adhesive in order to achieve a good match.

Primers may be applied to the substrate copper/silver/gold and allowed to cure in place. The dielectric structure may then be directly injection molded onto the primed substrate, or a pre-formed dielectric structure may be thermally fixed to the substrate (using IR, Friction, or Ultrasonic processes for example). Adhesives may be applied to the substrate in the case of direct injection molding using the heat of the molten plastic to activate the adhesive. Or, the adhesives may be applied to either the substrate or the bottom of the preformed dielectric structure if the structure is formed prior to bonding. The energy required to activate the adhesive may be applied through hot air, induction, friction, or ultrasonic, processes. A means to apply even, consistent pressure may be used to force the activated (softened) adhesive into gaps and other flaws between the substrate and the dielectric structure.

From all of the foregoing, it will be appreciated that many variations of the disclosure can be accomplished by combining elements of one embodiment disclosed herein with another embodiment disclosed herein, whether or not such combinations have been explicitly depicted, as by the very disclosure herein such combinations have been inherently disclosed herein, and any and all such combinations are considered to fall within the ambit of the appended claims, and are furthermore considered to fall within the scope of the disclosure disclosed herein.

In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element such as a layer, film, region, substrate, or other described feature is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. And, any background information provided herein is provided to reveal information believed by the applicant to be of possible relevance to the disclosure disclosed herein. No admission is necessarily intended, nor should be construed, that any of such background information constitutes prior art against an embodiment of the disclosure disclosed herein.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

The term "or" means "and/or" unless clearly indicated otherwise by context. Reference throughout the specification to "an embodiment", "another embodiment", "some embodiments", "an aspect", and so forth, means that a particular element (e.g., feature, structure, step, or characteristic) described in connection with the embodiment is included in at least one embodiment described herein, and may or may not be present in other embodiments. In addition, it is to be understood that the described elements may be combined in any suitable manner in the various embodiments.

Unless specified to the contrary herein, all test standards are the most recent standard in effect as of the filing date of this application, or, if priority is claimed, the filing date of the earliest priority application in which the test standard appears.

The endpoints of all ranges directed to the same component or property are inclusive of the endpoints, are independently combinable, and include all intermediate points and ranges. For example, ranges of "up to 25 wt %, or 5 to 20 wt %" is inclusive of the endpoints and all intermediate values of the ranges of "5 to 25 wt %," such as 10 to 23 wt %, etc. The term comprising as used herein does not exclude the possible inclusion of one or more additional features. The term combination is inclusive of blends, mixtures, alloys, reaction products, and the like. Also, combinations comprising at least one of the foregoing or at least one of means that the list is inclusive of each element individually, as well as combinations of two or more elements of the list, and combinations of at least one element of the list with like elements not named.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

What is claimed is:

1. An electromagnetic, EM, device, comprising:

a substrate comprising a dielectric layer and a first conductive layer at a first side of the substrate, the substrate comprising a via that extends at least partially through the substrate from the first side toward an opposing second side of the substrate;

at least one dielectric structure comprising at least one non-gaseous dielectric material that forms a first dielectric portion that extends outward from the first side of the substrate, the first dielectric portion having a first average dielectric constant, the at least one dielectric structure further comprising a second dielectric portion that is contiguous with the first dielectric portion;

wherein the second dielectric portion extends into the via of the substrate, the via comprising a mechanical interlock surface; and wherein the at least one dielectric structure comprises a mechanical interlock between the second dielectric portion and the mechanical interlock surface of the via of the substrate.

2. The device of claim 1, wherein:

the second dielectric portion is seamless with the first dielectric portion, the second dielectric portion having the first average dielectric constant.

3. The device of claim 1, wherein:
the via extends through the first conductive layer but not through the dielectric layer of the substrate.

4. The device of claim 3, wherein:
the mechanical interlock surface is a retrograde surface formed on the first conductive layer.

5. The device of claim 1, wherein:
the substrate further comprises a second conductive layer at the second side of the substrate, the dielectric layer being disposed between the first and second conductive layers.

6. The device of claim 5, wherein:
the via extends completely through the substrate from the first side to the second side.

7. The device of claim 6, wherein:
the mechanical interlock surface is a retrograde surface formed on the second conductive layer.

8. The device of claim 7, wherein:
the second dielectric portion is seamless with the first dielectric portion, the second dielectric portion having the first average dielectric constant.

9. The device of claim 7, wherein:
the second dielectric portion is an adhesive material having a dielectric constant that is substantially matched to the first average dielectric constant.

10. The device of claim 6, wherein:
the mechanical interlock surface is a shoulder of the via at the second side of the substrate.

11. The device of claim 10, wherein:
the second dielectric portion extends beyond an outer surface of the second conductive layer proximate the mechanical interlock surface.

12. The device of claim 6, wherein:
the mechanical interlock surface is an inner surface of the via.

13. The device of claim 12, wherein:
the second dielectric portion extends only partially into the via forming an underfilled via.

14. The device of claim 12, wherein:
the second dielectric portion extends completely into the via forming a completely filled via.

15. The device of claim 4, wherein the EM device comprises a dielectric resonator antenna, DRA, and the first dielectric portion is at least part of the DRA.

16. The device of claim 9, wherein the EM device comprises a dielectric resonator antenna, DRA, and the first dielectric portion is at least part of the DRA.

17. A method of making an electromagnetic, EM, device comprising: a substrate comprising a dielectric layer and a first conductive layer at a first side of the substrate, the substrate comprising a via that extends at least partially through the substrate from the first side toward an opposing second side of the substrate; at least one dielectric structure comprising at least one non-gaseous dielectric material that forms a first dielectric portion that extends outward from the first side of the substrate, the first dielectric portion having a first average dielectric constant, the at least one dielectric structure further comprising a second dielectric portion that is contiguous with the first dielectric portion; wherein the second dielectric portion extends into the via of the substrate, the via comprising a mechanical interlock surface; and wherein the at least one dielectric structure comprises a mechanical interlock between the second dielectric portion and the mechanical interlock surface of the via of the substrate, the method comprising:
injection molding a dielectric composition onto the substrate to form the device, the dielectric composition forming at least part of the at least one dielectric structure.

18. The method of claim 17, wherein the dielectric composition comprises a thermoplastic polymer.

19. The method of claim 18, wherein an injection temperature of the dielectric composition during the molding is greater than a melt temperature of the thermoplastic polymer; preferably the injection temperature is 40° C. to 220° C., or 40° C. to 160° C., or 100° C. to 220° C.

20. The method of claim 17, wherein an injection pressure during the injection molding is 65 to 350 kPa.

21. The method of claim 17, wherein a mold temperature after the injection molding is 0 to 250° C., or 23 to 200° C. and is optionally maintained for 0.5 to 10 min.

22. The method of claim 17, wherein the injection molding comprises filling the mold with the dielectric composition in 0.1 to 10 seconds, or 0.5 to 5 seconds, or 0.2 to 1 second.

23. The method of claim 17, wherein no visible delaminations are present between the dielectric structure and the substrate.

24. The method of claim 17, further comprising forming a mechanical interlock between the dielectric composition and the substrate by etching the substrate prior to injection molding the dielectric composition onto the substrate.

25. The method of claim 17, further comprising depositing an adhesive material onto the substrate prior to the injection molding.

26. The method of claim 17, wherein the dielectric composition comprises a dielectric filler; wherein the dielectric filler has a multimodal particle size.

27. The method of claim 26, wherein the dielectric filler comprises a first plurality of particles having a first average particle size and a second plurality of particles having a second average particle size; wherein the first average particle size is greater than or equal to 7 times, or greater than or equal to 10 times, or 7 to 20 times the second average particle size.

28. The method of claim 17, wherein the dielectric composition comprises at least one of a flow modifier, a silane, or a flame retardant.

29. The method of claim 17, further comprising transmitting an ultrasonic wave onto at least one of the dielectric composition or the substrate during or after the injection molding.

* * * * *